US012351957B2

(12) United States Patent
Sloan et al.

(10) Patent No.: US 12,351,957 B2
(45) Date of Patent: Jul. 8, 2025

(54) BRAIDED JACKETS WITH LOW THICKNESS

(71) Applicant: KURARAY CO., LTD., Kurashiki (JP)

(72) Inventors: Forrest Sloan, Houston, TX (US); Patrick Coffey, Houston, TX (US)

(73) Assignee: KURARAY CO., LTD., Kurashiki (JP)

( * ) Notice: Subject to any disclaimer, the term of this patent is extended or adjusted under 35 U.S.C. 154(b) by 88 days.

(21) Appl. No.: 18/140,061

(22) Filed: Apr. 27, 2023

(65) Prior Publication Data

US 2024/0076814 A1 Mar. 7, 2024

Related U.S. Application Data

(63) Continuation of application No. 17/358,301, filed on Jun. 25, 2021, now Pat. No. 11,674,246.

(Continued)

(51) Int. Cl.

*D04C 1/12* (2006.01)
*D04C 1/02* (2006.01)

(Continued)

(52) U.S. Cl.

CPC ..... *D04C 1/12* (2013.01); *D04C 1/02* (2013.01); *D07B 1/025* (2013.01); *D07B 1/162* (2013.01);

(Continued)

(58) Field of Classification Search

CPC .. D07B 1/025; D07B 1/162; D07B 2201/102; D07B 2201/1096; D07B 2201/209; D04C 1/02; D04C 1/12

See application file for complete search history.

(56) References Cited

U.S. PATENT DOCUMENTS 10,167,582 B1 1/2019 Pilgeram
2010/0107384 A1 5/2010 Meyer (Continued)

FOREIGN PATENT DOCUMENTS

EP 0472260 A1 2/1992
WO WO-2019069817 4/2019
WO WO-2019147460 A1 8/2019

OTHER PUBLICATIONS

International Search Report and Written Opinion issued Sep. 30, 2021 in PCT/US2021/039061, 12 pages.

*Primary Examiner* — Shaun R Hurley
(74) *Attorney, Agent, or Firm* — Element IP, PLC

(57) ABSTRACT

Disclosed herein are methods for producing core-sheath structures by shaping at least one filament bundle containing a plurality of filaments to form at least one shaped strand of filaments, and braiding a plurality of strands, including the at least one shaped strand of filaments, over a core to form the core-sheath structure containing a braided sheath of the strands surrounding the core, wherein the shaped strand of filaments is an untwisted strand having a twist level of less than 1 turn per meter, a cross-sectional aspect ratio of the shaped strand of filaments is at least 3:1, as measured in the braided sheath, a thickness of at least a portion of the braided sheath ranges from about 10 to about 200 μm, and the braided sheath comprises a synthetic fiber having a tensile strength of greater than 12 cN/dtex. Also disclosed herein are core-sheath structures formed by such methods.

16 Claims, 10 Drawing Sheets

Related U.S. Application Data

(60) Provisional application No. 63/044,418, filed on Jun. 26, 2020.

(51) Int. Cl.
*D07B 1/02* (2006.01)
*D07B 1/16* (2006.01)

(52) U.S. Cl.
CPC ..... *D07B 2201/102* (2013.01); *D07B 2201/1096* (2013.01); *D07B 2201/209* (2013.01)

(56) References Cited

U.S. PATENT DOCUMENTS

| | | | | |
|---|---|---|---|---|
| 2010/0211154 | A1 | 8/2010 | Murayama | |
| 2012/0297746 | A1 | 11/2012 | Chou | |
| 2013/0247536 | A1* | 9/2013 | Erlendsson | A01K 75/00 57/309 |
| 2014/0025106 | A1 | 1/2014 | Olson | |
| 2015/0128792 | A1 | 5/2015 | Zachariades et al. | |
| 2018/0305865 | A1 | 10/2018 | Baldinger | |
| 2019/0223868 | A1 | 7/2019 | Coffey | |
| 2019/0301090 | A1 | 10/2019 | Jessup | |
| 2020/0056307 | A1 | 2/2020 | Konukoglu et al. | |

* cited by examiner

BRAIDED JACKETS WITH LOW THICKNESS

TECHNICAL FIELD

This application relates to materials technology in general and more specifically to the preparation of braided core-sheath structures having improved surface characteristics. More particularly, this application discloses core-sheath structures having a central core at least partially surrounded by a braided jacket (sheath) of low thickness and high strength. Core-sheath structures disclosed herein include cords that are useful, for example, as tensioning structures in medical applications.

BACKGROUND OF THE INVENTION

Braided cords having a central core surrounded by a braided jacket (sheath) are conventionally known and used in a wide variety of applications. Often described as "core-sheath" structures, these braided materials are useful in applications such as fishing lines, nets, blind cords, ropes and medical textiles.

In contrast to core-sheath structures, cords without the braided jacket are more prone to loss of integrity through untwisting and are more prone to damage to the load-bearing fibers through abrasion, cutting, or strand pull out.

In certain applications, such as surgical threads, the characteristics of the braided jacket can profoundly impact the functionality and utility of cords having a core-sheath structure. For example, because conventional sheath structures are typically formed by braiding twisted strands that resist flattening, conventional braided jackets tend to be rigid and thick structures that behave differently from their underlying core structures.

In small core-sheath cords for specialty applications where limited volume is available for passage of the cord, such as medical cords, the thickness of the protective jacket can be a limiting factor. If strands of the protective jacket (sheath) could be selectively flattened, then the volume taken up by the jacket could be minimized—thereby allowing the use of larger core structures (braids or twisted threads) to increase load bearing capacity within the same volume. An ability to selectively flatten the strands of the protective jacket could also allow the diameter of a core-sheath cord to be reduced while still maintaining the load bearing capacity of a conventional core-sheath cord having a larger diameter.

The use of a flattened jacket in a core-sheath structure could also enable the sheath to better conform to the cross-sectional shape of the core, especially in applications where the cross-sectional shape of a core-sheath cord is preferably controlled to enable better manipulation of the cord during use. An ability to control the shape of the jacket in a core-sheath structure could also enable the surface texturing of the core-sheath structure to be tailored to particular applications where surface texture and/or roughness is a factor.

SUMMARY OF THE DISCLOSURE

The present inventors have recognized that a need exists to discover methods and materials for producing core-sheath structures having thin braided sheaths that exhibit greater flexibility and controllability compared to conventional sheath structures. For example, a need exists to produce core-sheath cords where the braided sheath is in the form of a flattened jacket that dynamically conforms to the outer surface of the underlying central core while at the same time protecting the cord against damage. A need also exists to produce core-sheath structures where the texture of the braided jacket can be controlled in order to increase or decrease surface roughness compared to conventional jackets, which can be used to impart medical textiles and other cord-like structures with improved properties.

The following disclosure describes the preparation and utility of core-sheath structures having selectively-flattened braided sheaths that function to protect the core while at the same time being able to dynamically conform to the outer surface of the core.

Embodiments of the present disclosure, described herein such that one of ordinary skill in this art can make and use them, include the following:

(1) One aspect relates to methods for producing cords having a core-sheath structure by shaping at least one filament bundle comprising a plurality of filaments to form at least one shaped strand of filaments, and then braiding a plurality of strands, including the at least one shaped strand of filaments, over a core to form the core-sheath structure comprising a braided sheath of the strands surrounding the core. In some embodiments (a) the shaped strand of filaments is an untwisted strand having a twist level of less than 1 turn per meter, (b) a cross-sectional aspect ratio of the shaped strand of filaments is at least 3:1 as measured in the braided sheath, (c) a thickness of at least a portion of the braided sheath ranges from about 10 to about 200 μm, and/or (d) the braided sheath comprises a synthetic fiber having a tensile strength of greater than 12 cN/dtex; and (2) Another aspect relates to cord having a core-sheath structure comprising a core and a braided sheath of strands surrounding the core, the braided sheath comprising strands having a braid angle of 5° or more in a relaxed state, and wherein the strands having the braid angle of 5° or more in the relaxed state include at least one shaped strand of filaments. In some embodiments (a) the shaped strand of filaments is an untwisted strand having a twist level of less than 1 turn per meter, (b) a cross-sectional aspect ratio of the shaped strand of filaments is at least 3:1 as measured in the braided sheath, (c) a thickness of at least a portion of the braided sheath ranges from about 20 to about 200 μm, and/or (d) the braided sheath comprises a synthetic fiber having a tensile strength of greater than 12 cN/dtex.

Additional objects, advantages and other features of the present disclosure will be set forth in part in the description that follows and in part will become apparent to those having ordinary skill in the art upon examination of the following or may be learned from the practice of the present disclosure. The present disclosure encompasses other and different embodiments from those specifically described below, and the details herein are capable of modifications in various respects without departing from the present disclosure. In this regard, the description herein is to be understood as illustrative in nature, and not as restrictive.

BRIEF DESCRIPTION OF THE DRAWINGS

Embodiments of this disclosure are explained in the following description in view of figures that show.

DETAILED DESCRIPTION

Figure 1:
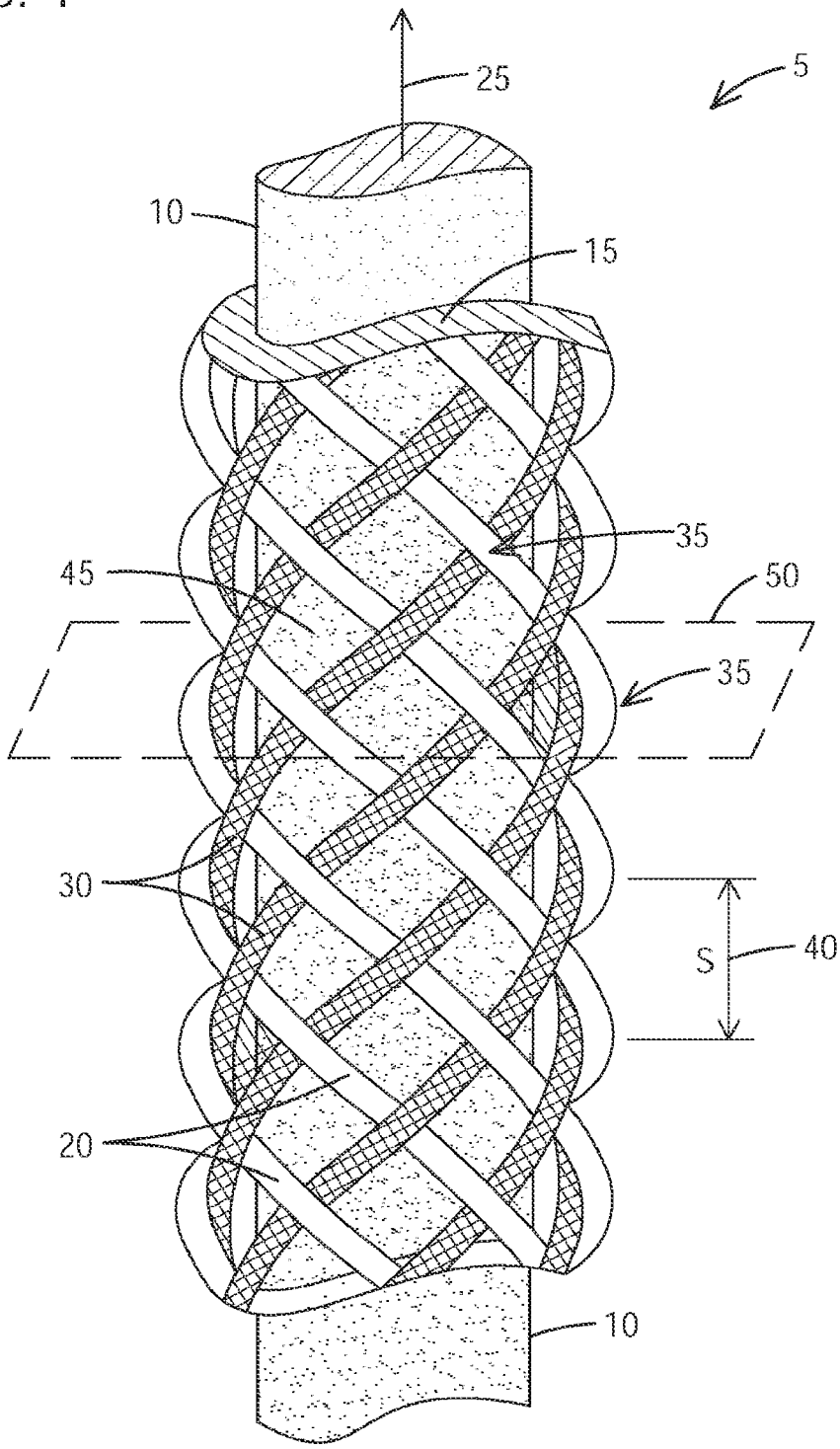
FIG. 1 illustrates a section of a core-sheath structure having a central core partially surrounded by a biaxial braided jacket (sheath) formed from strands braided in the left (Z) and right (S) directions.

Embodiments of this disclosure include various methods for producing core-sheath structures, as well as cords obtained by these methods. Certain, non-limiting, applications for the core-sheath structures of the present disclosure are also described herein.

Unless otherwise defined, all technical and scientific terms used herein have the same meaning as commonly understood by persons of ordinary skill in the relevant art. In case of conflict, the present specification, including definitions, will control.

Unless stated otherwise, all percentages, parts, ratios, etc., are by weight.

When an amount, concentration, or other value or parameter is given as a range, or a list of upper and lower values, this is to be understood as specifically disclosing all ranges formed from any pair of any upper and lower range limits, regardless of whether ranges are separately disclosed. Where a range of numerical values is recited herein, unless otherwise stated, the range is intended to include the endpoints thereof, and all integers and fractions within the range. It is not intended that the scope of the present disclosure is to be limited to the specific values recited when defining a range.

The use of "a" or "an" to describe the various elements and components herein is merely for convenience and to give a general sense of the disclosure. This description should be read to include one or at least one and the singular also includes the plural unless it is clear that it is otherwise intended.

Unless expressly stated to the contrary, "or" and "and/or" refers to an inclusive and not to an exclusive. For example, a condition A or B, or A and/or B, is satisfied by any one of the following: A is true (or present) and B is false (or not present), A is false (or not present) and B is true (or present), and both A and B are true (or present).

The terms "about" and "approximately" as used herein refer to being nearly the same as a referenced amount or value, and should be understood to encompass ±5% of the specified amount or value.

The term "substantially" as used herein, unless otherwise defined, means all or almost all or the vast majority, as would be understood by the person of ordinary skill in the context used. It is intended to take into account some reasonable variance from 100% that would ordinarily occur in industrial-scale or commercial-scale situations.

Throughout the present description, unless otherwise defined and described, technical terms and methods employed to determine associated measurement values are in accordance with the description of ASTM D855/D885M-10A (2014), Standard Test Methods for Tire Cords, Tire Cord Fabrics, and Industrial Filament Yarns Made From Man-made Organic-base Fibers, published October 2014.

For convenience, many elements of the various embodiments disclosed herein are discussed separately. Although lists of options may be provided and numerical values may be in ranges, the present disclosure should not be considered as being limited to the separately described lists and ranges. Unless stated otherwise, each and every combination possible within the present disclosure should be considered as explicitly disclosed for all purposes.

The materials, methods, and examples herein are illustrative only and, except as specifically stated, are not intended to be limiting. Methods and materials similar or equivalent to those described herein may also be used in the practice or testing of the present disclosure.

Core-Sheath Structures Having Shape-Controlled Jackets

Embodiments described herein include methods and materials for producing core-sheath structures having shape-controlled jackets (sheaths) that exhibit improved characteristics compared to conventional braided sheaths. Shape-controlled jackets of low thickness can, in some cases, more tightly conform the shape of the sheath to the outer surface of the core in order to control the texturing and surface roughness of the resulting core-sheath structure.

The term "core-sheath structure" as used herein describes cord-like structures having an outer sheath (jacket) of braided strands at least partially surrounding a central core. Different perspectives and embodiments of such core-sheath structures are illustrated in FIGS. 1-3, 7A, 7B, and 8-10.

FIG. 1 illustrates the basic components of a core-sheath structure 5 including a central core 10 that is partially surrounded in this depiction by a biaxial braided jacket (sheath) 15 formed of S-strands 20 braided in a left-hand direction along a braid axis 25 of the core 10 and of Z-strands 30 braided in a right-hand direction along the braid axis 25.

As shown in FIG. 1, the surface of the braided jacket (sheath) 15 includes protrusions 35 where the S- and Z-strands 20 and 30 overlap. The distance (S) 40 between adjacent protrusions 35 situated along the braid axis 25 direction of the braided jacket (sheath) 15 is indirectly related to the pick count of the braid. In a braided rope or jacket, the "pick count" defines the number of strands rotating in one direction (i.e., the S-strands 20 or the Z-strands 30 in FIG. 1) over one cycle length divided by the cycle length. Pick count is generally expressed in terms of the number of crossovers per inch or per meter. Thus, as the distance (S) 40 in FIG. 1 increases the pick count of the braided jacket (sheath) 15 decreases.

Because the central core 10 in the depiction of FIG. 1 is only partially surrounded by the braided jacket (sheath) 15, numerous gaps 45 also exist in the braided sheath 15 indicating a surface coverage of less than 100%. In other core-sheath structures where the surface coverage of the braided jacket (sheath) 15 approaches or exceeds 100%, no gaps 45 would exist in the braided sheath 15.

FIG. 1 also depicts a "plane P" 50 that defines a cross section of the core-sheath structure 5 at a point along the braid axis 25 where the protrusions 35 formed by the overlapping S- and Z-strands 20 and 30 exist. The same "plane P" 50 is defined as the plane of the paper in FIGS. 2, 3, 8 and 9.

As explained above, embodiments of this disclosure include core-sheath structures having shaped-controlled (flattened) jackets of low thickness than can more tightly conform to the outer surface of the core in order to control the texturing and surface roughness of the outside surface of the core-sheath structures. Comparing FIGS. 2 and 3 illustrates this feature.

Figure 2:
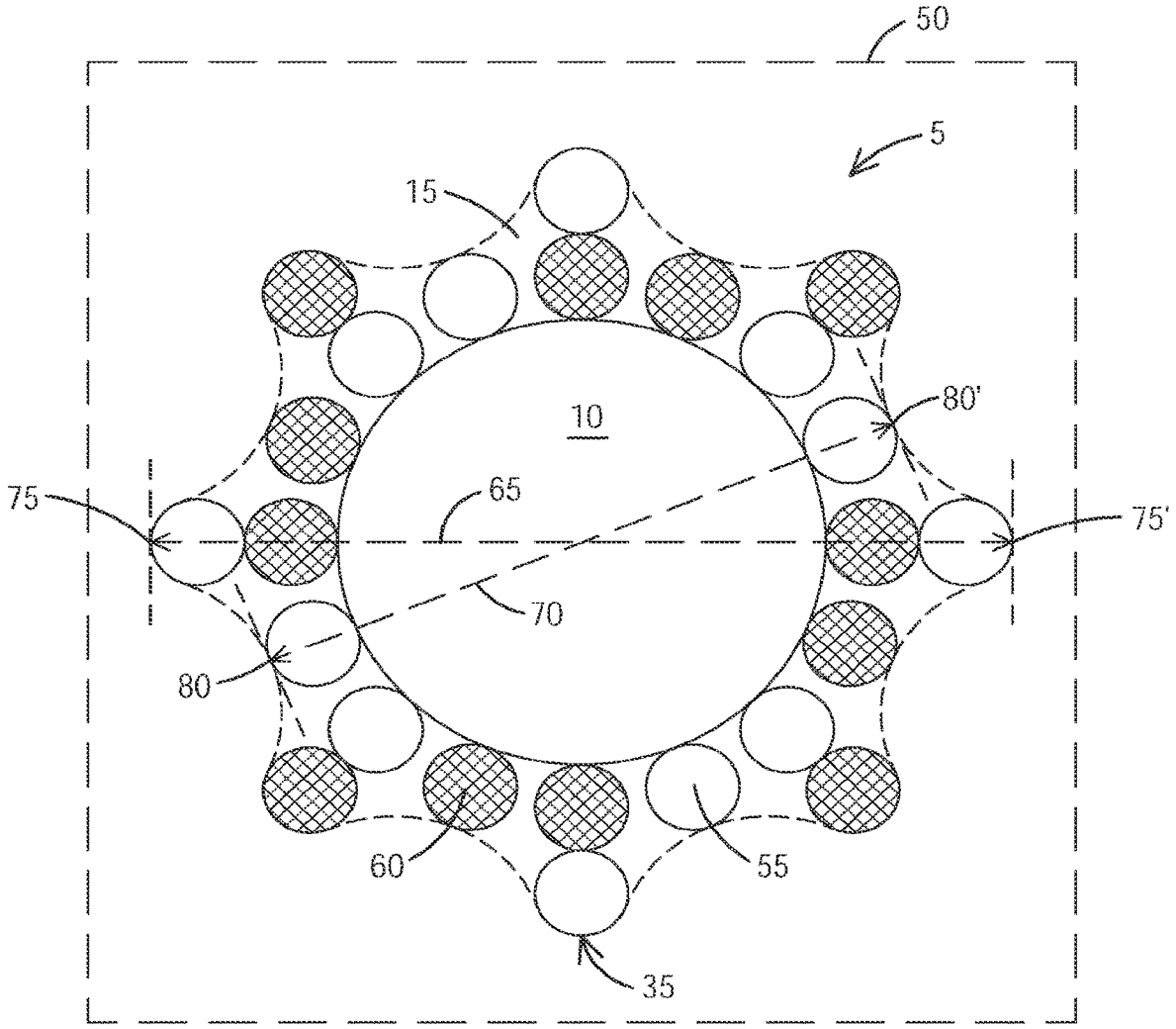
FIG. 2 illustrates the cross-section of a conventional core-sheath structure having a central core surrounded by a braided jacket (sheath) formed from twisted Z and S strands that resist flattening and form thick protrusions (bulges) at points where the Z and S strands overlap.
Figure 3:
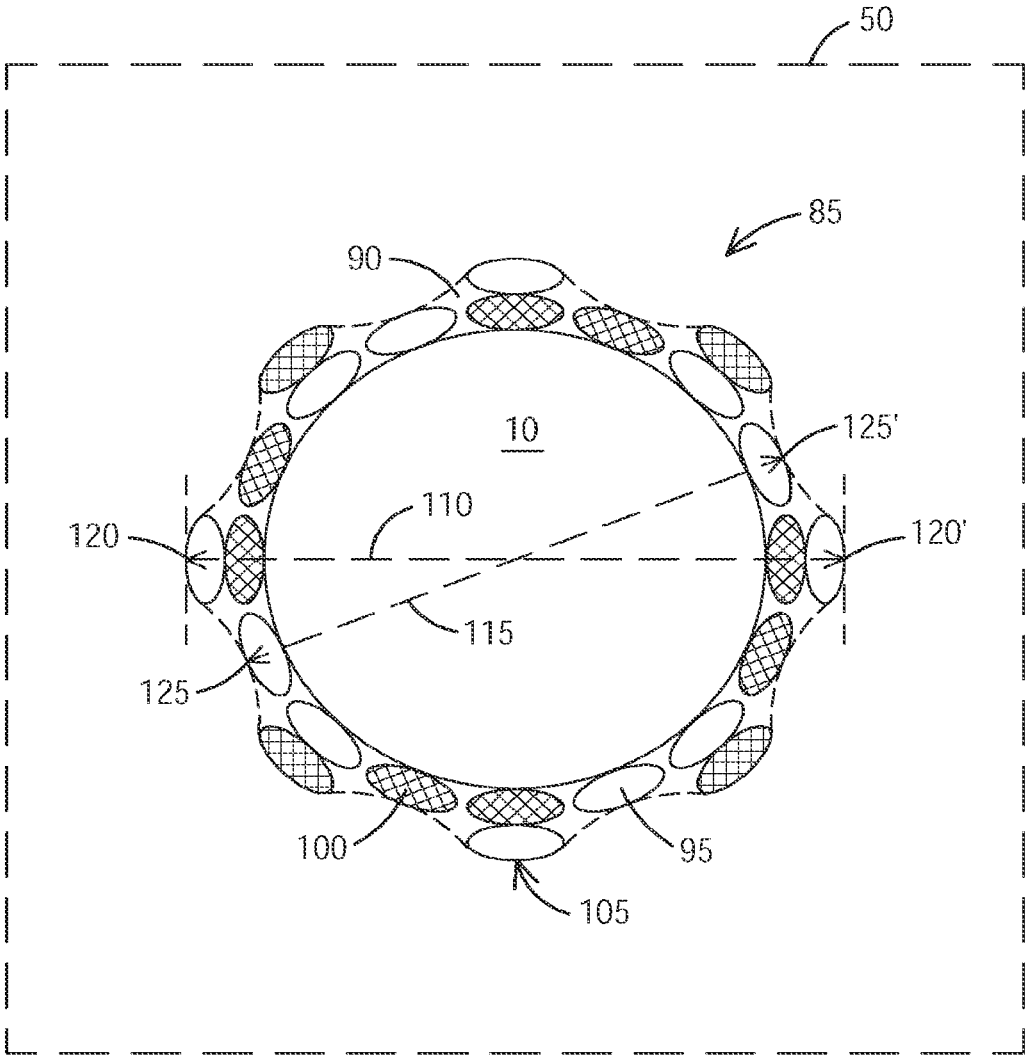
FIG. 3 illustrates the cross-section for a core-sheath structure of the present disclosure having a central core surrounded by a flattened braided jacket (sheath) formed from untwisted Z and S strands that are shaped to have a cross-sectional aspect ratio of at least 3:1.

FIG. 2 illustrates the cross-section of a conventional core-sheath structure 5 having a central core 10 surrounded by a biaxial braided jacket (sheath) 15 formed from twisted S- and Z-strands 55 and 60 that are braided along the braid axis (not shown), extending outward in a direction perpendicular to the "plane P" 50, of the core 10. As shown in FIG. 2, the lateral surface of the braided jacket (sheath) 15 includes protrusions 35 where the S- and Z-strands 55 and 60 overlap.

FIG. 2 also illustrates the maximum and minimum diameters ($D_{max}$ & $D_{min}$) 65 and 70 of the braided sheath 15, as measured within the cross-sectional "plane P" 50. $D_{max}$ 65 is the maximum diameter as measured between the protrusions 75 and 75' situated on opposite sides of the braided sheath 15; whereas $D_{min}$ 70 is the minimum diameter as measured between non-overlapped S- or Z-strands 80 and 80' situated on opposite sides of the braided sheath 15.

Because the braided sheath 15 in the conventional core-sheath structure 5 of FIG. 2 is formed using twisted S- and Z-strands that are rigid and resist flattening, large protrusions 35 exist on the lateral surface of the braided sheath 15 leading to significant texturing and surface roughness of the core-sheath structure 5. In contrast, FIG. 3 illustrates an embodiment of the present disclosure in which the use of shaped S- and Z-strands leads to a flattened braided sheath having reduced texturing and surface roughness compared to the conventional core-sheath structure 5 of FIG. 2.

FIG. 3 illustrates the cross-section of a core-sheath structure 85 of the present disclosure having a central core 10 surrounded by a flattened braided jacket (sheath) 90 formed from non-twisted S- and Z-strands 95 and 100 that are shaped to have cross-sectional aspect ratios of at least 3:1. The shaped S- and Z-strands 95 and 100 are braided along the braid axis (not shown), extending outward in a direction perpendicular to the "plane P" 50, of the core 10. As shown in FIG. 3, the lateral surface of the braided jacket (sheath) 90 includes significantly smaller protrusions 105 (where the shaped S- and Z-strands 95 and 100 overlap) compared to the protrusions 35 in the braided jacket 15 of FIG. 2.

FIG. 3 also illustrates the maximum and minimum diameters ($D_{max}$ & $D_{min}$) 110 and 115 of the braided sheath 90, as measured within the cross-sectional "plane P" 50. $D_{max}$ 110 is the maximum diameter as measured between the protrusions 120 and 120' situated on opposite sides of the braided sheath 90; whereas $D_{min}$ 115 is the minimum diameter as measured between non-overlapped S- or Z-strands 125 and 125' situated on opposite sides of the braided sheath 90.

Importantly, the difference ($\Delta D$) between the $D_{max}$ and the $D_{min}$ 100 and 115 of the braided sheath 90 in FIG. 3—($\Delta D = D_{max} - D_{min}$)—is significantly less than the difference $\Delta D$ of the braided sheath 15 of FIG. 2 due to the presence of the shaped S- and Z-strands 95 and 100 in the braided sheath 90 of FIG. 3.

Because the flattened braided sheath 90 in the core-sheath structure 85 of FIG. 3 is formed using non-twisted strands in both the S and Z directions 95 and 100 that are shaped to have cross-sectional aspect ratios of at least 3:1, significantly smaller protrusions 105 are formed compared to the protrusions 35 of FIG. 2. Consequently, the use of the shaped S- and Z-strands 95 and 100 in FIG. 3 leads to a flattened braided sheath 90 having reduced texturing and surface roughness compared to the conventional core-sheath structure 5 of FIG. 2.

Methods for Producing Core-Sheath Structures

Embodiments described herein include methods for producing core-sheath structures having shape-controlled jackets with areas of low thickness. Some embodiments relate to methods including the steps of (i) shaping at least one filament bundle comprising a plurality of filaments to form at least one shaped strand of filaments, and then (ii) braiding a plurality of strands, including the at least one shaped strand of filaments, over a core to form a core-sheath structure comprising a braided sheath of the strands surrounding the core. Such methods may be performed such that (a) the shaped strand of filaments is an untwisted strand having a twist level of less than 1 turn per meter, (b) a cross-sectional aspect ratio of the shaped strand of filaments is at least 3:1 as measured in the braided sheath, (c) a thickness of at least a portion of the braided sheath ranges from about 10 to about 200 μm, and/or (d) the braided sheath comprises a synthetic fiber having a tensile strength of greater than 12 cN/dtex.

Figure 4A:
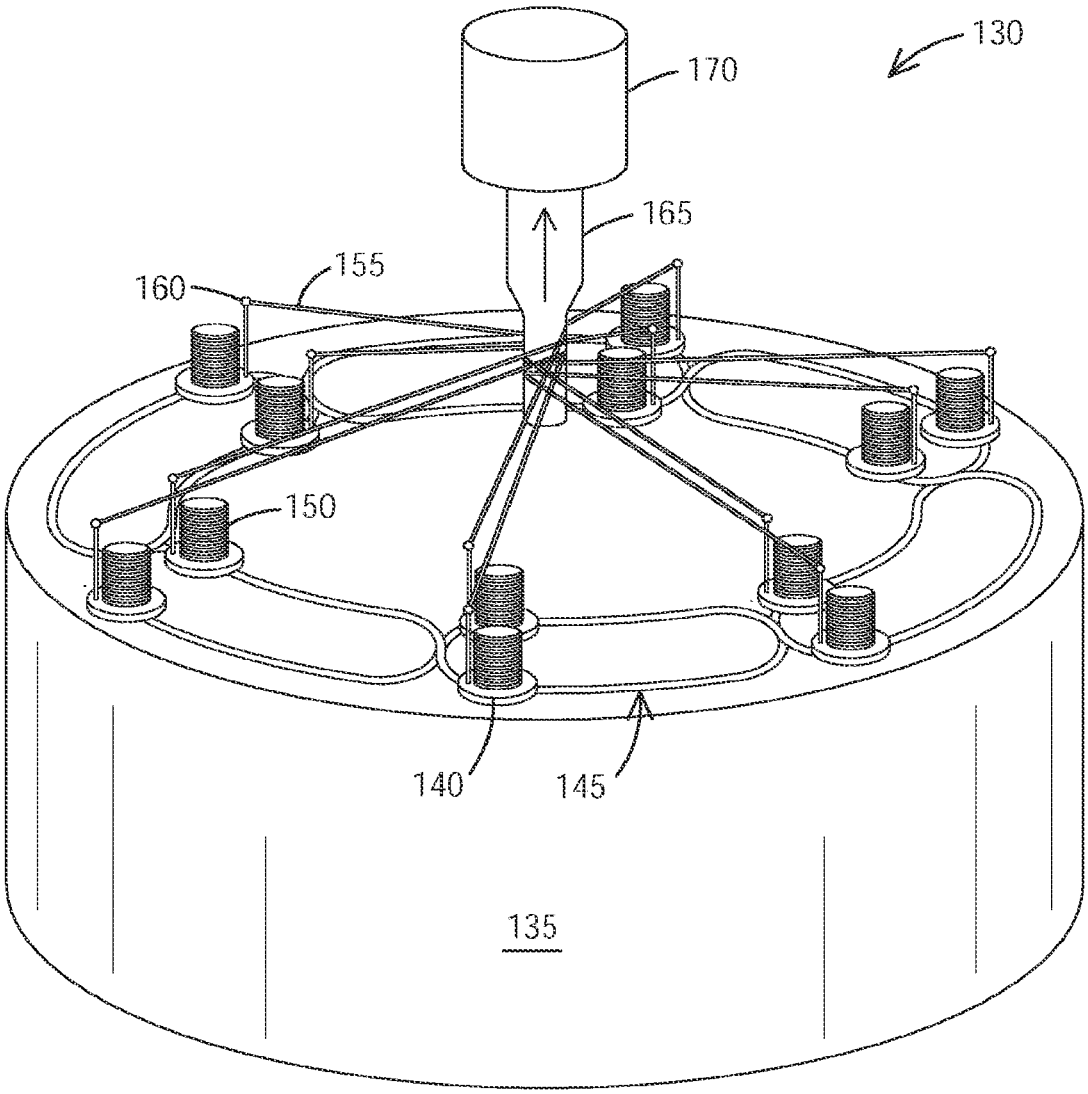
FIG. 4A illustrates one embodiment of a 12-carrier braiding apparatus capable of producing core-sheath structures of the present disclosure.
Figure 4B:
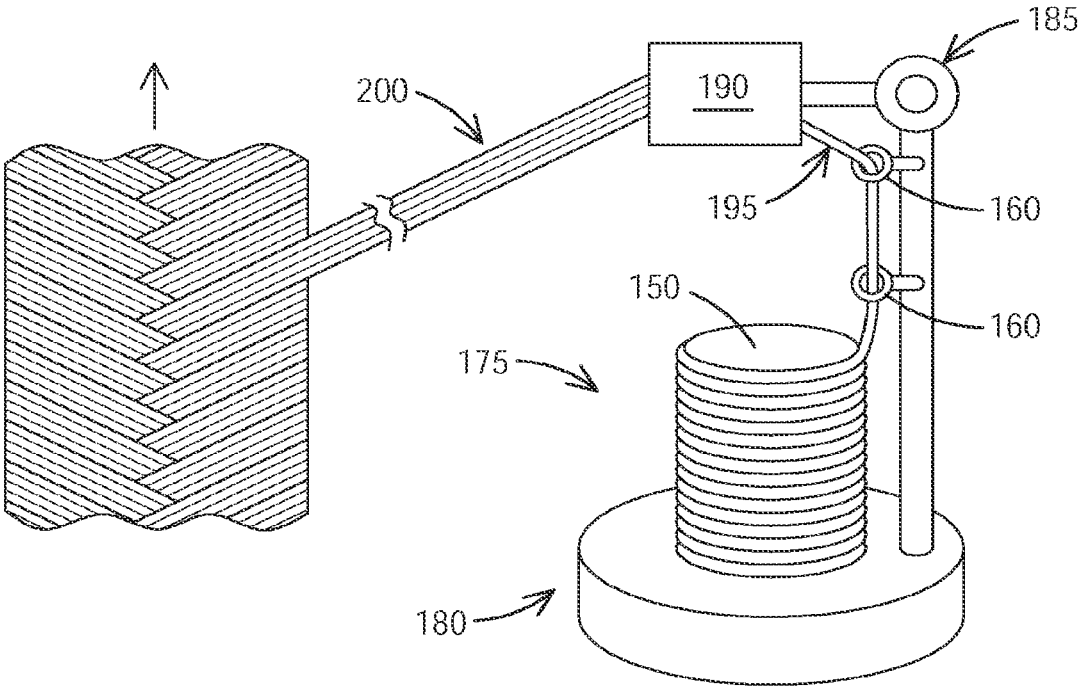
FIG. 4B illustrates one embodiment of a modified braider carrier that is capable of being used in the production of core-sheath structures of the present disclosure.
Figure 4C:
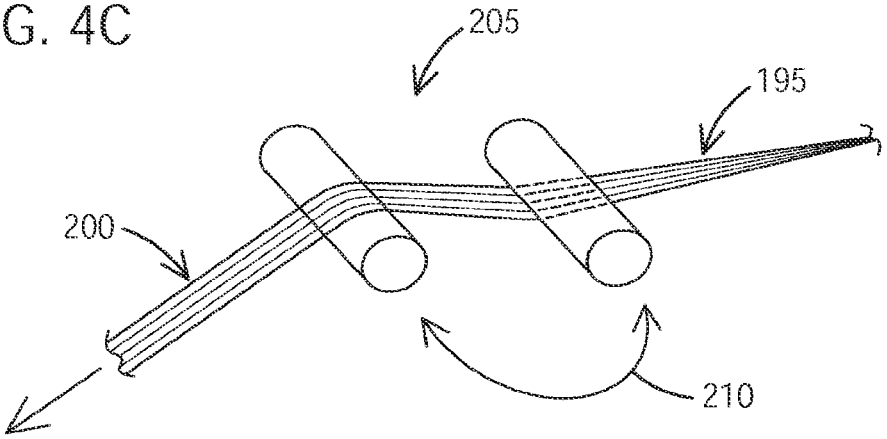
FIG. 4C illustrates one embodiment of a shaping device that is capable of being used in the production of core-sheath structures of the present disclosure.

FIGS. 4A thru 4C illustrate braiding apparatuses that can be used to produce core-sheath structures of the present disclosure.

FIG. 4A illustrates one embodiment of a braiding apparatus 130 that can be used to produce core-sheath structures of the present disclosure. The braiding apparatus 130 includes a main enclosure 135 that rotates during operation and mounts twelve (12) carriers 140 that independently move along the upper surface of the main enclosure 135 in circular carrier paths 145 that enable the carriers 140 to follow continuous "FIG. 8" patterns. Each carrier 140 includes a bobbin 150 capable of dispensing a filament bundle 155 via a guide 160 that directs the filament bundle 155 towards a central winding shaft 165 that be controlled with a winding shaft moving mechanism 170 to move in an axial direction. FIG. 4A illustrates a pull-off orientation for each bobbin 150; however, a roll-off orientation for each bobbin 150 also may be used.

Aside from modifications to the braiding apparatus 130 that may be performed to enable it to more effectively shape at least one of the filament bundles 155 prior to braiding about the central winding shaft 165, the braiding apparatus 130 functions in a similar manner compared to conventional braiding apparatuses. That is, a tubular braid sheath may be formed on a core (depicted as the central winding shaft 165 in FIG. 4A) by crossing the strands (including at least one pre-shaped strand) diagonally in such a way that each group of strands pass alternately over and under a group of strands laid in the opposite direction.

In some embodiments modifications enabling a braiding apparatus to more effectively shape at least one of the filament bundles may be performed on a commercially-available braiding apparatus. Braiding equipment is commercially available and units of differing capabilities may be obtained. Suitable braiding equipment may include commercially-available braiders from Steeger USA (Inman, South Carolina USA), Herzog GmbH (Oldenburg, Germany), and other manufacturers, that are designed for the braiding of fine-denier filaments and bundles. However, the equipment available for modification is not limited to any specific manufacturers. Essential to the sheath core design is that the braiding equipment be equipped with the ability to braid around a central core. Upper and lower limits for the number of carriers included in the braiding apparatus are not limited and may be determined according to the desired braid parameters and design. As explained below in greater detail, some embodiments include the use of braiding apparatuses capable of producing triaxial braids that include longitudinal strands.

In some embodiments modifications enabling a braiding apparatus to more effectively shape at least one of the filament bundles 155 may be performed on at least one of the carriers 140. FIG. 4B illustrates one embodiment of a modified braider carrier 175 that includes a carrier plate 180, a bobbin 150, at least one strand guide 160 (two being depicted in the embodiment of FIG. 4B), an auto-align swivel 185, and a shaping device 190. The modified braider carrier 175 includes an additional function whereby a non-shaped filament bundle 195 is guided to the shaping device 190 that shapes the filament bundle 195 into a shaped strand of filaments 200 prior to the shaped strand 200 being braided about the central winding shaft (core) 165 (see FIG. 4A).

In some embodiments the least one shaped strand of filaments may be formed by shaping a heated filament bundle, an agitated filament bundle, or a combination thereof. The shaping process may be improved, for example to obtain a shaped strand of filaments having a higher cross-section aspect ratio, by using a heated filament bundle including at least one of a lubricant, a fiber and a surface-coated filament. The presence of a lubricant can improve a heated shaping process by reducing the viscosity of the lubricant. Agitated filaments bundles may be obtained, for example, by applying ultrasound to a filament bundle.

Shaping devices 190 of many designs and functions can be used in modified braider carriers 175 of the present disclosure. For example, FIG. 4C illustrates one embodiment in which the shaping device 205 includes two rollers 210 over which the non-shaped filament bundle 195 is sequentially passed under tension in order to produce the shaped strand of filaments 200. In other embodiments the shaping device 190 functions by tensioning the filament bundle 195 over at least one surface (e.g., at least one roller) in order to compress the filament bundle, or functions by tensioning the filament bundle 195 over at least one curved surface such that the filaments separate from one another to form a flat fiber band. In other embodiments the shaping may involve squeezing the filament bundle between two surfaces (e.g., two rollers). In still other embodiments, the shaping may involve a gating process in which filaments in the filament bundle pass through separate spaces (e.g., gates, openings) in order to separate the filaments (as single filaments, or as sets of filaments) from one another to form a flat fiber band.

Shaping processes of the present disclosure are not limited to shaping that occurs on the carrier 140, and may involve the use of shaping device(s) positioned between the carrier 140 and the central winding shaft (core) 165 (see FIG. 4A). That is, the shaping process may occur on the carrier, between the carrier and the central winding shaft (core), or a combination thereof. Shaping devices positioned between the carrier and the central winding shaft (core) may employ the same designs and functions as the shaping devices on the carrier, or may employ different designs and functions.

Shaping processes of the present disclosure can be used to form shaped strands of filaments having a wide variety of different cross-sectional shapes. For example, the shaping may be performed such that the shaped strand of filaments has a cross section including a curved surface, may be performed such that the shaped strand of filaments has a cross section including a flat surface, or a combination thereof. In some embodiments the shaped strand of filaments may have an oval cross section, while in other embodiments the shaped strand of filaments may have a curved cross section including a convex section and/or a concave section. In other embodiments the shaping may be performed such that the shaped strand of filaments is a flat fiber band having a cross section including a flat surface.

Figure 5:
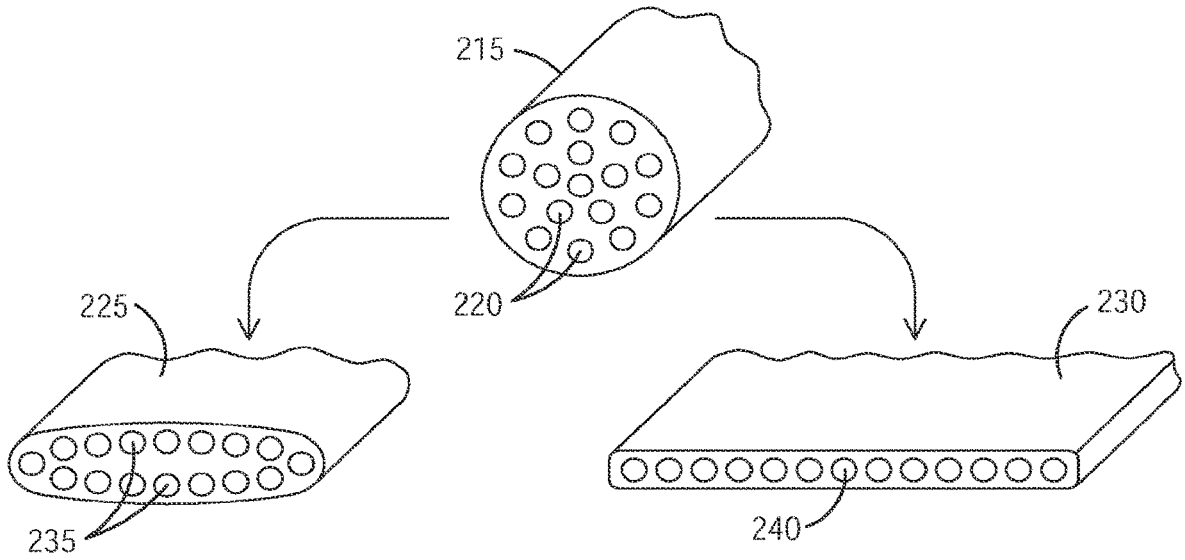
FIG. 5 illustrates the cross-section of a non-shaped filament bundle (strand) in comparison to shaped strands of the present disclosure having curved and flat cross sections.
Figure 6:
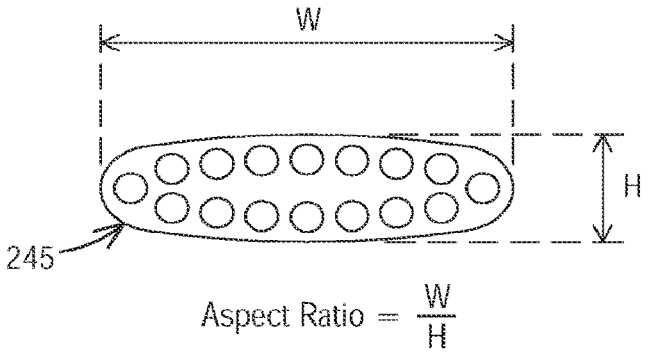
FIG. 6 illustrates the aspect ratio of a shaped strand of filaments having a curved cross section.

FIG. 5 illustrates two non-limiting embodiments where the shaping of a filament bundle 215 comprising a plurality of filaments 220 produces an oval-shaped strand of filaments 225 or produces a flat fiber band 230 having a cross section including a flat surface. As illustrated in the oval-shaped strand of filaments 225, in some embodiments the width of a shaped strand of filaments having a curved cross section may include at least two monofilaments 235 stacked in a transverse direction across the width of the shaped strand. As illustrated in the flat fiber band 230, in some embodiments the width of a shaped strand of filaments may include a single layer of monofilaments 240 arranged side-by-side. FIG. 6 illustrates the aspect ratio calculation for a shaped strand of filaments 245 having a curved (oval) cross section.

In some embodiments braided sheaths of the present disclosure may include at least one oval-shaped strand of filaments having an ovality ranging from about 67% to about 98%. Ovality (%) is calculated using the following equation:

$$\text{Ovality } \% = \frac{(\text{Max } OD - \text{Min } OD)}{\text{Max } OD} \times 100\%$$

where Max OD is a maximum outside diameter of the strand in micrometers (μm), and Min OD is a minimum outside diameter of the strand in micrometers (μm). In other embodiments the ovality of the oval-shaped strands of filaments may range from about 75% to about 98%, or from about 80% to about 98%.

Figure 7A:
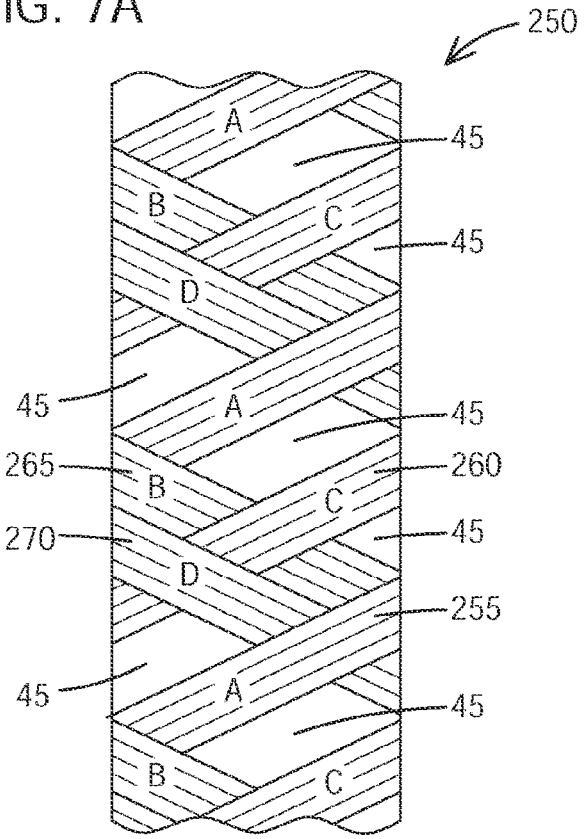
FIG. 7A illustrates the surface of a non-optimized braided jacket (sheath) having gaps.
Figure 7B:
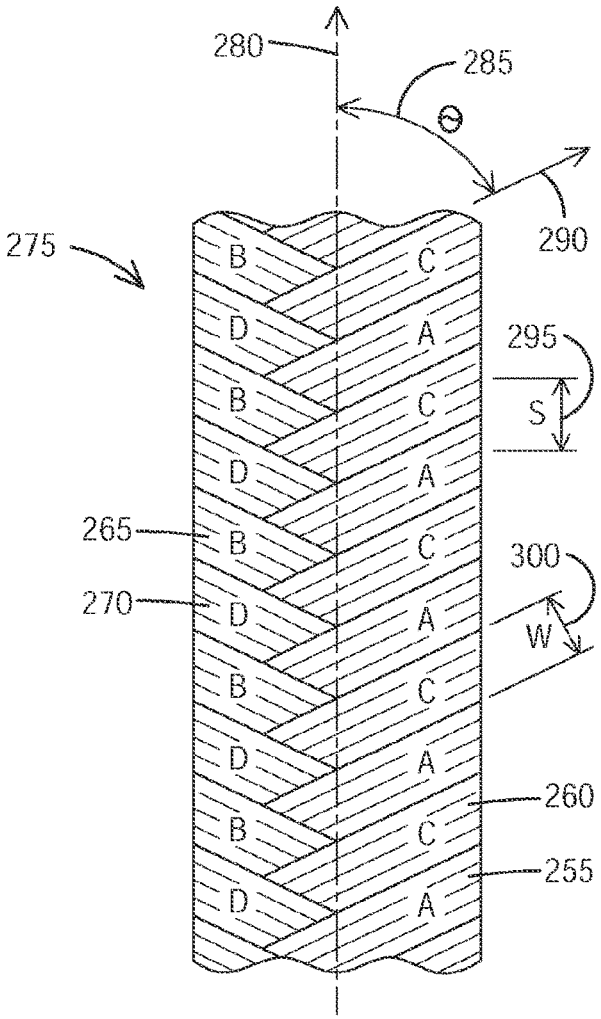
FIG. 7B illustrates the surface of an optimized braided jacket (sheath) with no gaps and higher surface coverage compared to the non-optimized braided jacket of FIG. 7A.

As explained above, gaps 45 (see FIG. 1) may exist in the braided sheath 15 when the surface coverage is less than 100%. Braiding methods of the present disclosure may include techniques for optimizing the braid pattern of the braided sheath 15 to eliminate gaps 45 and maximize surface coverage. FIGS. 7A and 7B illustrate the before and after effects of performing optimization techniques on braiding methods of the present disclosure.

FIG. 7A illustrates the surface of a non-optimized braided sheath 250 having a surface coverage of less than 85% and including numerous gaps 45. In this particular example, the braided sheath 250 is formed from four shaped strands of filaments including two right-hand braided Z-strands 255 and 260 (designated as strands "A" and "C" in FIG. 7A) and two left-hand braided S-strands 265 and 270 (designated as strands "B" and "D" in FIG. 7A). The actual braid pattern may be varied according to the pattern of interlacing. Common patterns may include plain, twill and panama weaves as well as other braid patterns known to persons of ordinary skill in the relevant art.

Factors that may be altered to adjust and optimize the characteristics of a braided sheath include the pick count of the braiding process, the end count (number of strands) of the braid, and the width of the shaped strands of filaments in the braided sheath. Increasing pick count during the braiding process tends to increase the surface coverage (and reduce gap sizes) of the resulting braided sheath, assuming that the end count of the braid and the width of the shaped strands are held constant. Increasing the end count of the braid also tends to increase the surface coverage (and reduce gap sizes) of the resulting braid, assuming that the pick count of the braid and the width of the shaped strands are held constant. Increasing the width of the shaped strands also tends to increase the surface coverage (and reduce gap sizes) of the resulting braid, assuming that the pick count and end count of the braid are held constant.

As an example of a braid optimization, a core-sheath structure having a four-strand braided sheath is formed over a colored (high-visibility) core material using a method of the present disclosure. The four strands include two right-hand braided Z-strands (designated as strands "A" and "C") and two left-hand braided strands (designated as strands "B" and "D"), see FIG. 7A. While performing a two-step (shaping and then braiding) method of the present disclosure, the pick count of the braided sheath is incrementally increased while the end count of the braid and the width of the shaped strands are held constant. The width of the shaped strands is held constant by maintaining constant tensioning of the filament bundles passing through the shaping devices 190 (see, e.g., FIG. 4B) during the shaping process. A core-sheath (cord) structure is produced that includes different sections corresponding to the different pick counts produced as the pick count is incrementally increased.

The resulting core-sheath (cord) structure is then visually analyzed using a microscope to measure the sizes of the gaps 45 in the different sections corresponding to the different pick counts. For example, the sizes of the gaps 45 can be measured using a digital microscope having an optical magnification of about 200×, such as a DINO-LITE™ USB digital microscope. An optimal pick count is determined based on the section where the gaps 45 are small enough to produce a surface coverage of about 95%. In other instances, the optimal pick count occurs where the gaps 45 are small enough to produce a surface coverage ranging from about 80% to about 99%.

Using the optimal pick count, another core-sheath structure having the four-strand braided sheath is formed over the colored (high-visibility) core material using the method of the present disclosure. While performing the two-step (shaping and then braiding) method, the pick count is held constant at the optimal pick count but the width of the shaped strands is incrementally increased by increasing the tensioning of the filament bundles passing through the shaping devices 190 (see, e.g., FIG. 4B) during the shaping process. A core-sheath (cord) structure is produced that includes different sections corresponding to the different widths of the shaped strands as the tensioning of the filaments passing through the shaping devices 190 is incrementally increased.

The resulting core-sheath (cord) structure is then visually analyzed using the microscope to measure the sizes of the gaps 45 in the different sections corresponding to the different widths of the shaped strands of filaments. An optimal width is determined based on the section where the gaps 45 disappear corresponding to a surface coverage of about 100%. In other instances, the optimal width occurs where the gaps 45 are small enough to produce a surface coverage ranging from about 90% to about 100%. Some core-sheath structures may be optimized in a manner such that gaps are deliberately included in the jacket (sheath), or such that strands forming the jacket (sheath) can overlap. Therefore, the surface coverage of optimized core-sheath structures may range from about 25% to about 150% depending upon the intended application.

FIG. 7B illustrates the surface of an optimized braided sheath 275 having a surface coverage of about 100%, where the right-hand braided Z-strands 255 and 260 (designated as strands "A" and "C") and the left-hand braided S-strands 265 and 270 (designated as strands "B" and "D") are tightly packed together without gaps or significant overlap. FIG. 7B also illustrates the braid axis 280 of the core-sheath structure along with the optimized braid angle (θ) 285, direction bias 290, distance (S) 295 and strand width (W) 300 of the optimized braided sheath 275.

Other braid optimization methods may be used where pick count, end count and strand width are modulated in different orders to obtain different levels of surface coverage with or without gaps. In some embodiments the surface coverage of the braided sheath over the core is at least 85%. In other embodiments the surface coverage may range from about 25% to about 100%. In still other embodiments the surface coverage may exceed 100%—such that adjacent strands at least partially overlap with one another. As explained above, in some embodiments the surface coverage may range from about 25% to about 150%. For example, the surface coverage may range from about 50% to about 125%, or from about 75% to about 110%, or from about 85% to about 105%, or from about 90% to about 100%.

As explained above, in some optimized core-sheath structures the surface coverage may fall significantly below 100% (due to the deliberate presence of gaps) or significantly above 100% (due to strands of the jacket (sheath) being overlapped). Such embodiments can be advantageous, for example, when it is beneficial to obtain a jacket (sheath) of higher surface roughness (due to the presence of gaps and/or protrusions) or when additional protection for the core (due to the presence of overlapping strands) is desired.

The pick count of the braided sheath in a relaxed state (i.e., a natural resting state where no tension is applied to the core-sheath structure) may range from 30 to 3000 filament unit crossovers per meter. In other embodiments the pick count of the braided sheath may range from about 30 to 3000 crossovers per meter, or from about 50 to about 2000 crossovers per meter, or from about 50 to 1000 crossovers per meter, in the relaxed state.

The strand (end) count of the braided sheath depends upon the requirements of the core-sheath structure and the capabilities of the braiding device. Strand (end) counts ranging from 4 to more than 200 may be employed depending upon the particular application. In some embodiments the strand (end) count of the braided sheath may range from 4 to 96 ends, and in other applications a strand (end) count limited to about 24 ends may be appropriate. For example, the strand (end) count of core-sheath structures of the present disclosure may range from 4 to 24 ends, or from 4 to 16 ends, or from 4 to 12 ends, or from 4 to 8 ends, or from 4 to 6 ends. In medical applications, core-sheath structures of the present disclosure often range from 4 to 24 ends.

The braid angle of the braided sheath in a relaxed state generally ranges from about 5° to about 85°. In other embodiments the braid angle of the S- and Z-strands of the braided sheath in the relaxed state may range from about 5° to about 60°, or from about 10° to about 75°, or from about 15° to about 60°, or from about 20° to about 45°, or from about 5° to 45°.

Braid angle selection can have a profound effect on the properties of core-sheath structures of the present disclosure. For example, reducing the braid angle tends to increase the modulus and/or the strength of the resulting core-sheath structure, due to the load-bearing fibers of the jacket (sheath) being more aligned with the direction of the load (i.e., along the braid axis 25). Braid angle selection can also be used to control load sharing between core and the jacket (sheath). In some embodiments a balance of load sharing between the core and the jacket (sheath) is important for obtaining core-sheath structures having optimal tensile strength and durability properties.

Articles Having Core-Sheath Structures

Embodiments of the present disclosure also include core-sheath structures produced by the methods described above. For example, some embodiments relate to core-sheath structures comprising (I) a core and (II) a braided sheath of strands surrounding the core, wherein the braided sheath comprising strands having a braid angle of 5° or more in a relaxed state, and the strands having the braid angle of 5° or more in the relaxed state include at least one shaped strand of filaments. Such core-sheath structures may be produced such that (A) the shaped strand of filaments is an untwisted strand having a twist level of less than 1 turn per meter, (B) a cross-sectional aspect ratio of the shaped strand of filaments is at least 3:1 as measured in the braided sheath, (C) a thickness of at least a portion of the braided sheath ranges from about 20 to about 200 μm, and/or (D) the braided sheath contains a synthetic fiber having a tensile strength of greater than 12 cN/dtex.

Core-sheath structures of the present disclosure include embodiments wherein the braided sheath contains at least one untwisted shaped strand of filaments having a twist level of less than 0.75 turn per meter, or less than 0.5 turn per meter, or less than 0.25 turn per meter.

In some embodiments the cross-sectional aspect ratio of the shaped strand filaments ranges from 3:1 to 50:1, or ranges from 3:1 to 20:1, or ranges from 4:1 to 15:1, or ranges from 5:1 to 10:1. In other instances the cross-sectional aspect ratio of the shaped strand of filaments may range from about 3:1 to about 50:1 (ovality about 68-98%), or from about 4.1:1 to about 50:1 (ovality about 75.5-98%), or from about 5.6:1 to about 50:1 (ovality about 82-98%), or from about 8:1 to about 22.2:1 (ovality about 87.5-95.5%)

The thickness of at least a portion of the braided sheath may range from about 16 μm to about 250 μm, or from about 40 μm to about 200 μm, or from about 50 μm to about 175 μm, or from about 60 μm to about 150 μm, or from about 50 μm to about 125 μm.

As explained above, braided sheaths of the present disclosure may contain a synthetic fiber having a tensile strength of greater than 12 cN/dtex. The synthetic fiber may have a tensile strength of at least 13 cN/dtex, or at least 15 cN/dtex, or at least 20 cN/dtex. In some embodiments the synthetic fiber contained in the braided sheath may have a tensile strength ranging from 13 cN/dtex to 50 cN/dtex, or from 15 cN/dtex to 45 cN/dtex.

In addition to the synthetic fiber having a tensile strength of greater than 12 cN/dtex, braided sheaths in core-sheath structures of the present disclosure may include other synthetic and non-synthetic fibers and filaments having tensile strengths ranging from about 1 cN/dtex to about 30 cN/dtex. For example, some embodiments include core-sheath structures containing a braided sheath comprising the synthetic fiber having the tensile strength of greater than 12 cN/dtex and a synthetic or non-synthetic fiber having a tensile strength of less than 12 cN/dtex. In other embodiments the braided sheath does not include a synthetic fiber having a tensile strength of less than 12 cN/dtex. Braided sheaths of the present disclosure may also contain both the synthetic fiber having the tensile strength of greater than 12 cN/dtex and a non-synthetic fiber having a tensile strength of greater than 12 cN/dtex.

Shaped strands of filaments may also have tensile strengths of greater than 12 cN/dtex, or may have tensile strengths ranging from about 1 cN/dtex to about 45 cN/dtex.

As explained above, methods of the present disclosure include a step of shaping at least one filament bundle comprising a plurality of filaments to form at least one shaped strand of filaments. In some embodiments the plurality of filaments contained in the filament bundle may include at least one filament having a non-round cross section. Such filaments having a non-round cross section may be formed by an extrusion process using an extrusion die having a non-round cross-sectional profile. For example, filament bundles of the present disclosure may contain at least one filament having an oval cross section, a triangular cross section, a square cross section, a multilobal cross section, a hollow cross section, or other cross sections known to be produced by extrusion.

Core-sheath structures of the present disclosure may also include core-sheath structures having a maximum (outer) diameter ranging from about 15 μm to about 20 mm. In other embodiments the outer diameter of the core-sheath structures may range from about 20 μm to about 8 mm, or from about 30 μm to about 5 mm, or from about 50 μm to about 3 mm, or from about 50 μm to about 1 mm.

A wide variety of core sizes may also be used in the embodiments of the present disclosure. For example, a maximum diameter of the core may range from about 10 μm to about 20 mm. In other embodiments the maximum diameter of the core may range from about 15 μm to about 10 mm, or from about 25 μm to about 5 mm, or from about 50 μm to about 1 mm, or from about 50 μm to about 500 μm.

Core-sheath structures of the present disclosure may employ twisted or non-twisted cores, as well as monofilament cores. In some embodiments the core comprises at least two core strands twisted together at a twist level of from greater than 0 to 1600 turns per meter. The number of core strands included in the twisted or untwisted core may range from 1 to 500, and the twist level of the core or the core strands used to produce a multi-strand core may range from 1 to 1600 turns per meter. Combinations of twisted, non-twisted, and/or braided filaments may also be used to produce cores in the core-sheath structures of the present disclosure.

Figure 8:
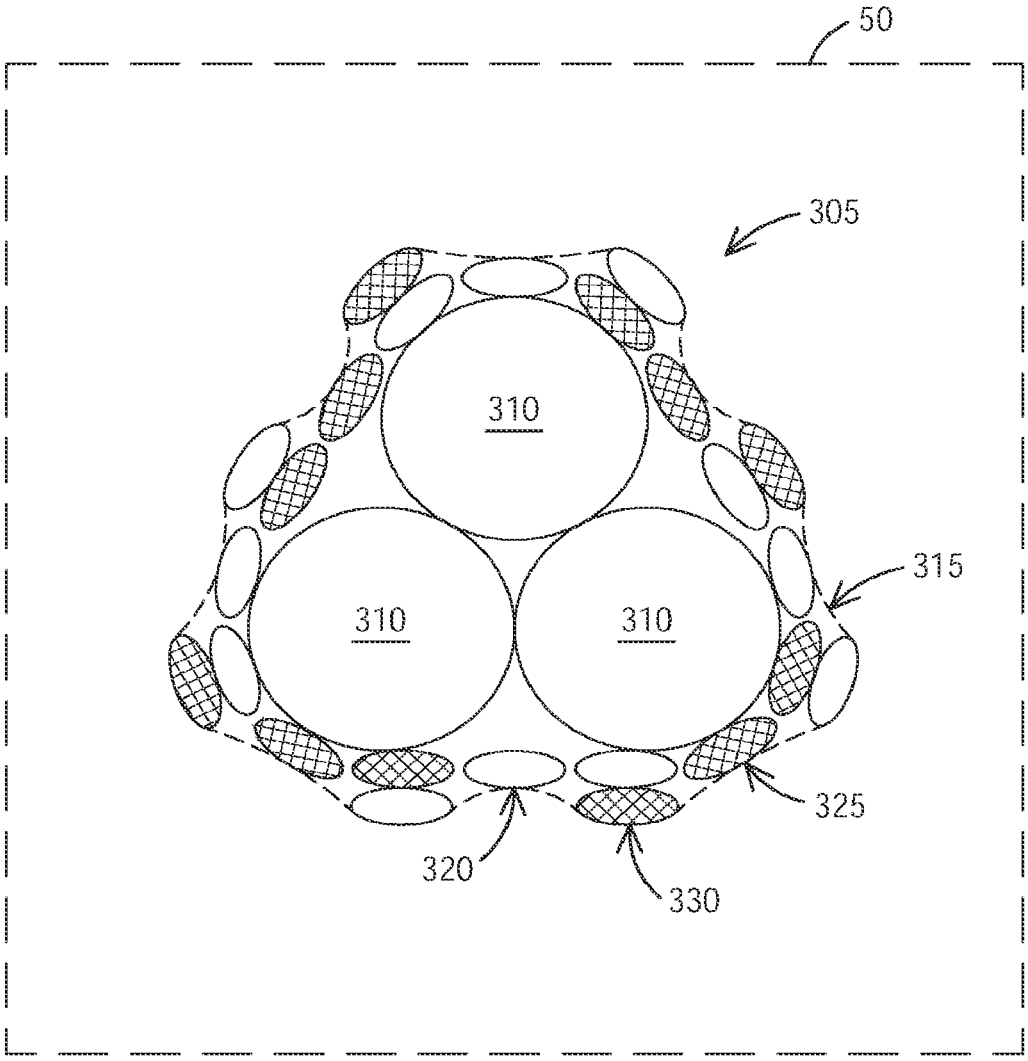
FIG. 8 illustrates the cross-section for a core-sheath structure of the present disclosure having a triangular central core surrounded by a flattened braided jacket (sheath) formed from untwisted Z and S strands that are shaped to have a cross-sectional aspect ratio of at least 3:1.

FIG. 8 illustrates the cross section of one embodiment of the present disclosure in which the core-sheath structure 305 includes a twisted, 3-strand core comprising three strands 310 twisted together at a twist level of from greater than 0 to 1600 turns per meter such that the core has a triangular cross section. In this embodiment the triangular 3-strand core is surrounded by a flattened braided jacket (sheath) 315 formed from untwisted S- and Z-strands 320 and 325 that are shaped to have cross-sectional aspect ratios of at least 3:1. Due to the relatively small size of the protrusions 330 where the S- and Z-strands 320 and 325 overlap, the flattened braided sheath 315 tightly conforms to the outer surface of the core such that the cross-sectional shape of outer surface of the sheath 315 largely emulates the shape of the outer surface of the triangular core.

As explained above, the production method of the present disclosure can be advantageous because the ability to shape the filament bundle(s) into at least one shaped strand of filaments allows the resulting core-sheath structure to have a thinner braided sheath with less texturing and lower surface roughness compared to conventional core-sheath structures. For example, as illustrated in the comparison between FIG. 2 and FIG. 3, the difference ($\Delta D$) between the maximum diameter of the braided sheath ($D_{max}$) and the minimum diameter of the braided sheath ($D_{min}$) 100 and 115 of the braided sheath 90 in FIG. 3—($\Delta D = D_{max} - D_{min}$)—is significantly less than the difference $\Delta D$ of the braided sheath 15 of FIG. 2. In some embodiments a ratio of the $D_{max}$ to the $D_{min}$ ranges from about 1.05:1 to about 2.5:1. In other embodiments the ratio of the $D_{max}$ to the $D_{min}$ ranges from about 1:1:1 to about 1.5:1, or from about 1.05:1 to about 1.35:1, or from about 1.1:1 to about 1.3:1, or from about 1.1:1 to about 1.2:1.

Another measure of the ability to shape the filament bundles into shaped strands is the flattening factor of the shaped strand of filaments. For core-sheath structures comprising a round core with a circular cross section and a braided sheath consisting of shaped strands and having a surface coverage of 100% or less, flattening factor is defined as:

$$F = \frac{(D_{max} - D_{min})}{2D_s}$$

where $D_{max}$ is a maximum diameter of the braided sheath as measured in a cross-sectional plane of the cord that is perpendicular to a longitudinal axis of the cord in micrometers (μm), $D_{min}$ is a minimum diameter of the braided sheath as measured in the cross-sectional plane of the cord that is perpendicular to the longitudinal axis of the cord, in micrometers (μm), and $D_s$ is a minimum diameter of the filament bundle prior to the shaping, as measured in a cross-sectional plane of the filament bundle that is perpendicular to a longitudinal axis of the filament bundle, in micrometers (μm).

Embodiments of the present disclosure include core-sheath structures comprising a round core with a circular cross section and a braided sheath consisting of shaped strands, wherein the flattening factor of the shaped strands ranges from about 0.05 to about 0.45. In other embodiments the flattening factor may range from about 0.1 to about 0.35, or from about 0.10 to about 0.30, or from about 0.1 to about 0.25.

In some embodiments the core in the core-sheath structures is a surface treated core. For example, the core component surface may be corona or plasma treated prior to application of the braided sheath. Such treatment may create surface imperfections or modifications that enhance contact (surface interaction) between the core and an inner surface of the braided sheath, further enhancing the interaction between the core and the braided sheath.

Another aspect of the present disclosure relates to the proportion of strands used in the braiding step that are shaped strands. In some embodiments all of the strands used in the braiding step are shaped strands, whereas in other embodiments only a fraction of the strands used in the braiding step are shaped strands. For example, in some embodiments all of the S-strands braided in the left-hand direction are shaped strands, whereas all of the Z-strands braided in the right-hand direction are non-shaped strands that are not subjected to the shaping step that occurs before the braiding step, or vice versa. In still other embodiments only a fraction of one or both of the S- and Z-strands may be shaped strands. Embodiments of the present disclosure include core-sheath structures including only one shaped strand in the braided sheath, or including all (100%) shaped strands in the braided sheath, or including any combination between one shaped strand and 100% of shaped strands in the braided sheath.

Embodiments of the present disclosure of also include core-sheath structures in which the braided sheath is a hybrid jacket including at least one of the shaped strand of filaments having a cross-sectional aspect ratio of at least 3:1 and at least one non-shaped strand of filaments having a cross-sectional aspect ratio of less than 2:1. For example, in some embodiments the braided sheath is a hybrid jacket including at least one shaped strand of filaments having a cross-sectional aspect ratio of at least 3:1 and at least one twisted (non-shaped) strand of filaments having a twist level of greater than 0 to 1600 turns per meter. As explained above, a twisted filament bundle (i.e., twisted strand) is more rigid and less prone to shaping compared to an untwisted filament bundle.

Hybrid jackets of the present disclosure may also be formed using filament bundles (strands) containing filaments of different diameters (different linear densities). For example, hybrid jackets may be formed by threading high-density strands (formed of high-density filaments, e.g., 10-30 denier-per-filament (dpf) filaments) and low-density strands (formed of low-density filaments, e.g., 2.5-10 dpf filaments). Filament bundles formed of high-density (high-dpf) filaments are stiffer and less prone to crushing, but can be more difficult to shape (flatten) using compressive mechanisms—whereas filament bundles formed of low-density (low-dpf) filaments are softer and more flexible, but can be more fragile. Core-sheath structures in some embodiments of the present disclosure contain hybrid jackets formed of shaped strands of high-dpf filaments (10 dpf or greater) threaded in the S-direction and shaped strands of low-dpf filaments (less than 10 dpf) threaded in the Z-direction, or vice versa. Embodiments also include the use non-shaped strands of high-dpf filaments and/or low-dpf filaments. The use of high-dpf strands threaded in only one direction can lead to core-sheath structures exhibiting enhanced torsional stiffness in only one rotational direction.

Figure 9:
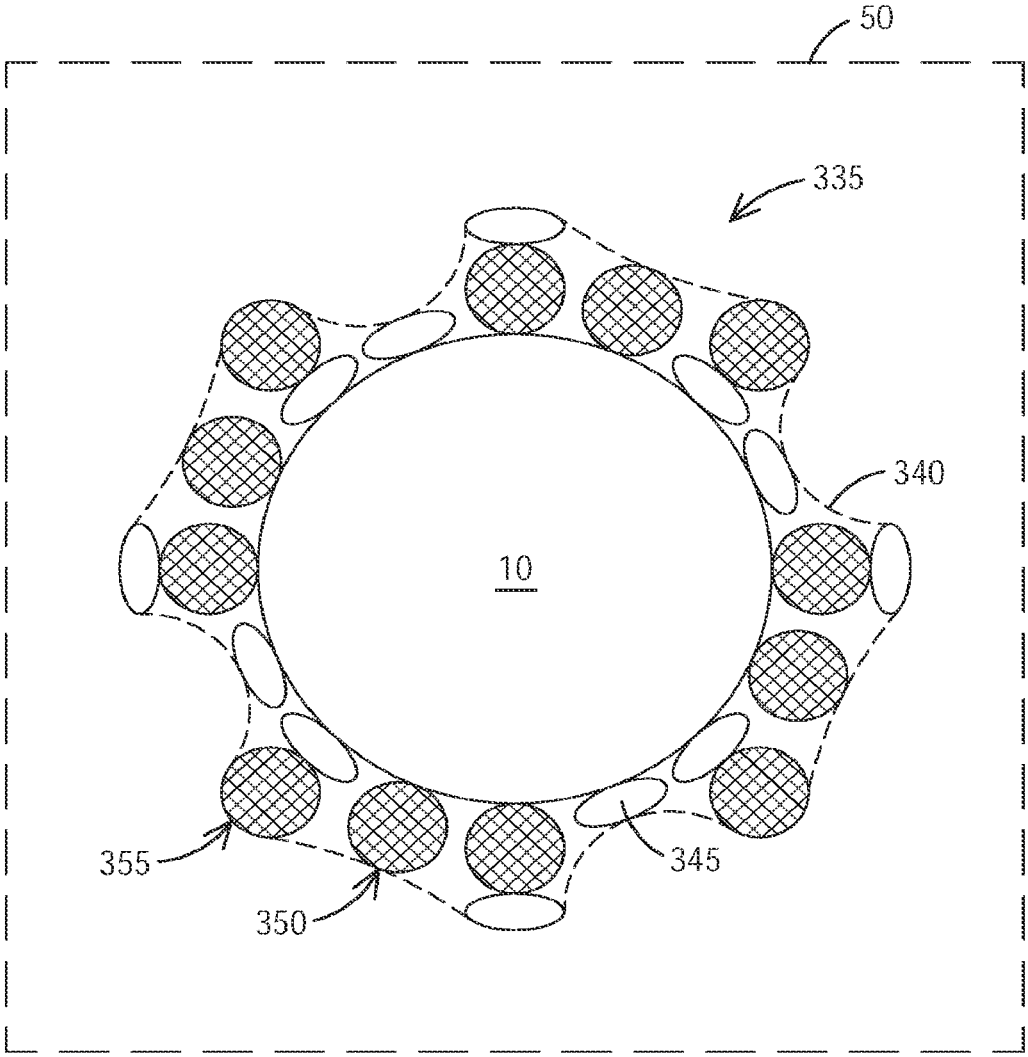
FIG. 9 illustrates the cross-section for a core-sheath structure of the present disclosure having a round central core surrounded by a hybrid braided jacket (sheath) formed from shaped S strands having a cross-sectional aspect ratio of at least 3:1 and from non-shaped Z strands having a cross-sectional aspect ratio of less than 2:1.

FIG. 9 illustrates the cross-section for a core-sheath structure 335 of the present disclosure having a round core 10 surrounded by a hybrid braided jacket (sheath) 340 formed from shaped S-strands 345 having a cross-sectional aspect ratio of at least 3:1 and from non-shaped Z-strands 350 having a cross-sectional aspect ratio of less than 2:1. A comparison of FIG. 3 and FIG. 9 illustrates that the presence of the non-shaped Z-strands 350 in the embodiment of FIG. 9 leads to larger protrusions 355 where the shaped S-strands 345 and the non-shaped Z-strands 350 overlap—compared to the embodiment of FIG. 3 where in the braided sheath 90 includes only the shaped S- an Z-strands 95 and 100. Thus, embodiments such as the illustration of FIG. 9 having a hybrid braided sheath can enable the texture and surface area of the outer surface of the resulting core-sheath structures to be controlled.

Core-sheath structures of the present disclosure may also include triaxial braided sheaths comprising, in addition to the S-strands 20 braided in the left-hand direction and the Z-strands 30 braided in the right-hand direction (see FIG. 1), longitudinal strands having a braid angle of less than 5° in a relaxed state. In some embodiments the triaxial braided sheath may include at least one shaped longitudinal strand formed by shaping at least one of the longitudinal strands prior to the braiding of the plurality of strands. For example, a triaxial braided sheath of the present disclosure may include, in addition to the S- and Z-strands, one shaped longitudinal strand, all shaped longitudinal strands, or any combination in between.

Figure 10:
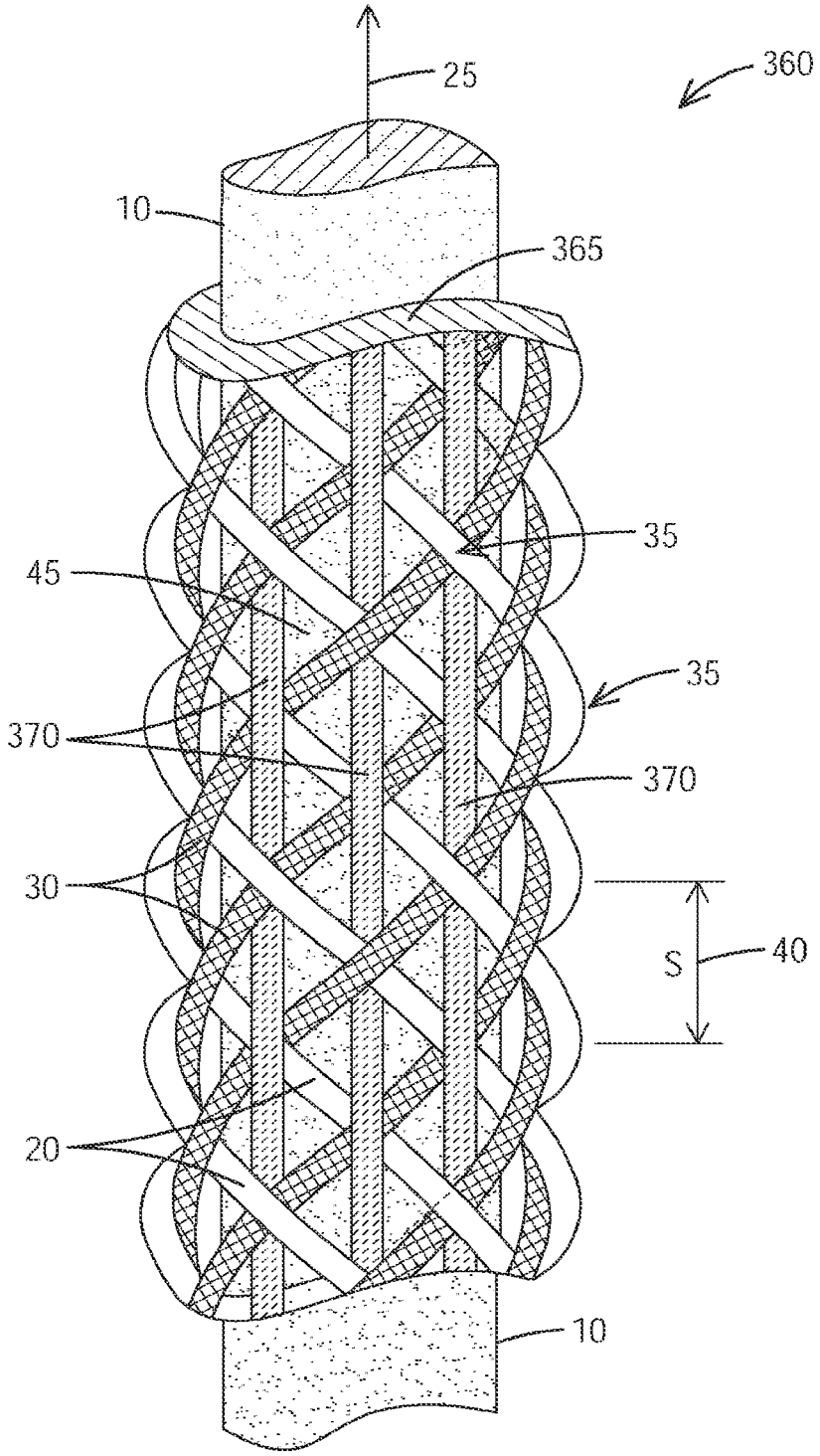
FIG. 10 illustrates a section of a core-sheath structure having a central core partially surrounded by a triaxial jacket (sheath) formed from strands braided in the Z and S directions as well as longitudinal strands having a braid angle of less than 5° in a relaxed state.

FIG. 10 illustrates a core-sheath structure 360 including a central core 10 that is partially surrounded by a triaxial braided jacket (sheath) 365 formed of S-strands 20 braided in the left-hand direction along a braid axis 25 of the core 10, Z-strands 30 braided in a right-hand direction along the braid axis 25, and longitudinal strands 370 braided along the braid axis 25 and having a braid angle of less than 5° in a relaxed state.

Core-sheath structures of the present disclosure may also be formed such that the filament bundle further comprises a lubricant, a fiber, a surface-coated filament, or combinations thereof. Lubricants used in the filament bundles of the present disclosure may include at least one of a lubricating filament and a lubricating fiber. Surface-coated filaments may include cross-linked or non-cross-linked silicone polymers as the surface coating.

The mass ratio of a mass of the braided sheath to a mass of the core, per unit length of the core-sheath structure, may range from about 2/98 to about 98/2. In other embodiments the mass ratio of a mass of the braided sheath to a mass of the core, per unit length of the core-sheath structure, is from about 2/98 to about 80/20, or from about 3/98 to about 75/25, or from about 4/98 to about 60/40, or from about 5/95 to about 45/55, or from about 20/80 to about 90/10, or from about 30/70 to about 80/20, or from about 40/60 to about 70/30. In some embodiments a linear mass density of the braided sheath is greater than a linear mass density of the core. In other embodiments the linear mass density of the braided sheath is equivalent to the linear mass density of the core, or the linear mass density of the braided sheath is less than the linear mass density of the core.

Core-sheath structures of the present disclosure may have linear mass densities ranging from about 30 denier to about 10,000 denier. In other embodiments the linear mass density of the core-sheath structure may range from about 40 denier to about 4500 denier, or from about 50 denier to about 4000 denier, or from about 100 denier to about 3000 denier, or from about 70 denier to about 2000 denier, or from about 80 denier to about 1500 denier, or from about 90 denier to about 1000 denier.

As explained above, methods of the present disclosure may include a step of shaping at least one filament bundle comprising a plurality of filament to form at least one shaped strand of filaments. In some embodiments the plurality of filaments contains filaments having linear mass densities ranging from about 0.1 to about 30 denier. In other embodiments the linear mass density of the filaments may range from about 0.2 to about 10 denier, or from about 0.4 to about 8.0 denier, or from about 0.6 to about 6.0 denier.

Shaped and/or non-shaped strands of the braided sheath may be identical in size, structure and composition, or the strands may differ in any or all of size, structure and composition. Thus, the braided sheath may be constructed of strands of differing denier, braid or twist. Further, the braided sheath may contain strands of differing chemical composition. Thus, braided sheaths of the present disclosure may be designed to control the strength and torque properties of core-sheath structures.

The chemical composition of the strands (or filaments) of the braided sheath may be of any high performance polymer known to provide a combination of high tensile strength, high tenacity and low creep and may be selected from but is not restricted to liquid crystalline polyester filaments, aramid filaments, co-polymer aramid filaments, polyether ether ketone filaments, poly(p-phenylene benzobisoxazole) (PBO) filaments, ultra-high molecular weight polyethylene filaments, high modulus polyethylene filaments, polypropylene filaments, polyethylene terephthalate filaments, polyamide filaments, high-strength polyvinyl alcohol filaments, polyhydroquinone diimidazopyridine (PIPD) filaments, and combinations thereof, just to name a few.

Polyhydroquinone diimidazopyridine (PIPD) filament fibers are based on polymers of the following repeating unit:

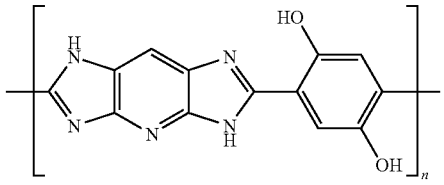

In some embodiments the plurality of filaments contained in the braided sheath includes at least one selected from a liquid crystalline polyester filament, an aramid filament, co-polymer aramid filament, a polyether ether ketone filament, a poly(p-phenylene benzobisoxazole) filament, an ultra-high molecular weight polyethylene filament, a high modulus polyethylene filament, a polypropylene filament, a polyethylene terephthalate filament, a polyamide filament, a polyhydroquinone diimidazopyridine filament, and a high-strength polyvinyl alcohol filament. In other embodiments the plurality of filaments includes at least two of these materials.

In some embodiments shaped and/or non-shaped strands of the braided sheath may contain at least one fiber selected from a liquid crystalline polyester fiber, an aramid fiber, a PBO fiber, an ultra-high molecular weight polyethylene fiber, and a high strength polyvinyl alcohol fiber. In other embodiments the shaped and/or non-shaped strands of the braided sheath may be selected from a liquid crystalline polyester fiber and an aramid fiber, and particularly a liquid crystalline polyester fiber.

Core-sheath structures of the present disclosure may, in some embodiments, include a core comprising at least one selected from the group consisting of a liquid crystalline polyester filament, an aramid filament, co-polymer aramid filament, a polyether ether ketone filament, a poly(phenylene benzobisoxazole) filament, an ultra-high molecular weight polyethylene filament, a polypropylene filament, a high modulus polyethylene filament, a polyethylene terephthalate filament, a polyamide filament, and a high-strength polyvinyl alcohol filament.

Polymerized units may include those illustrated shown in Table 1.

TABLE 1

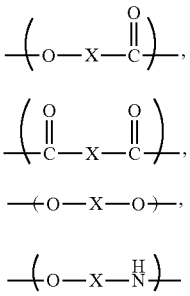

(in which X in the formulas is selected from the following structures)

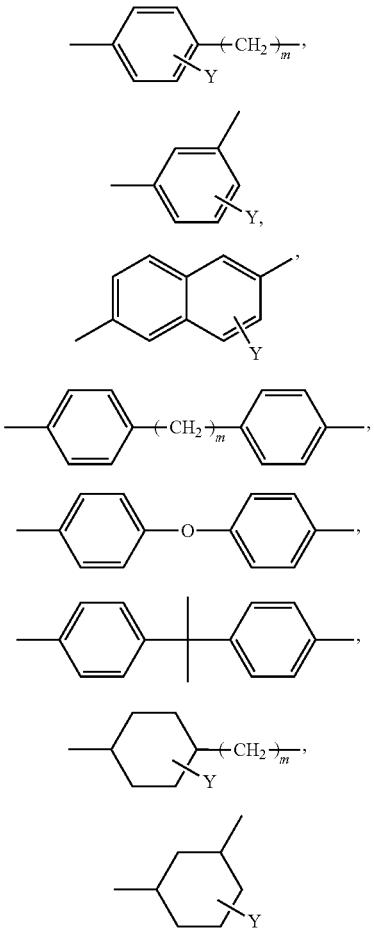

TABLE 1-continued (in which m = 0 to 2, and Y = a substituent selected from a hydrogen atom, a halogen atom, an alkyl group, an aryl group, an aralkyl group, an alkoxy group, an aryloxy group, and an aralkyloxy group)

Regarding the polymerized units illustrated in Table 1 above, the number of Y substituent groups is equal to the maximum number of substitutable positions in the ring structure, and each Y independently represents a hydrogen atom, a halogen atom (for example, a fluorine atom, a chlorine atom, a bromine atom, an iodine atom, etc.), an alkyl group (for example, an alkyl group having 1 to 4 carbon atoms such as a methyl group, an ethyl group, an isopropyl group, or a t-butyl group), an alkoxy group (for example, a methoxy group, an ethoxy group, an isopropoxy group, an n-butoxy group, etc.), an aryl group (for example, a phenyl group, a naphthyl group, etc.), an aralkyl group [a benzyl group (a phenylmethyl group), a phenethyl group (a phenylethyl group), etc.], an aryloxy group (for example, a phenoxy group, etc.), an aralkyloxy group (for example, a benzyloxy group, etc.), or mixtures thereof.

Liquid crystalline polyester fibers may be obtained by melt spinning of a liquid crystalline polyester resin. The spun fiber may be further heat treated to enhance mechanical properties. The liquid crystalline polyester may be composed of a repeating polymerized unit, for example, derived from an aromatic diol, an aromatic dicarboxylic acid, or an aromatic hydroxycarboxylic acid. The liquid crystalline polyester may optionally further comprise a polymerized unit derived from an aromatic diamine, an aromatic hydroxyamine, and/or an aromatic am inocarboxylic acid.

More specific polymerized units are illustrated in the following structures shown in Tables 2-4 below.

When the polymerized unit in the formulas is a unit which can represent plural structures, two or more units may be used in combination as polymerized units constituting a polymer.

In the polymerized units of Tables 2, 3, and 4, n is an integer of 1 or 2, and the respective units n=1, n=2 may exist alone or in combination; and $Y_1$ and $Y_2$ each independently may be a hydrogen atom, a halogen atom (for example, a fluorine atom, a chlorine atom, a bromine atom, an iodine atom, etc.), an alkyl group (for example, an alkyl group having 1 to 4 carbon atoms such as a methyl group, an ethyl group, an isopropyl group, or a t-butyl group), an alkoxy group (for example, a methoxy group, an ethoxy group, an isopropoxy group, an n-butoxy group, etc.), an aryl group (for example, a phenyl group, a naphthyl group, etc.), an aralkyl group (a benzyl group (a phenylmethyl group), a phenethyl group (a phenylethyl group), etc.), an aryloxy group (for example, a phenoxy group, etc.), an aralkyloxy group (for example, a benzyloxy group, etc.), or mixtures thereof. Among these groups, Y is preferably a hydrogen atom, a chlorine atom, a bromine atom, or a methyl group.

TABLE 2

(1)

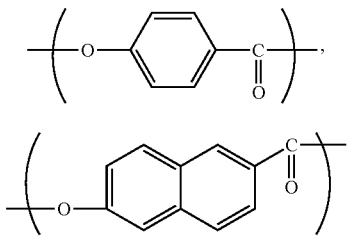

TABLE 2-continued
(2)
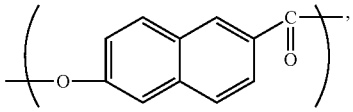
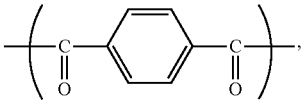
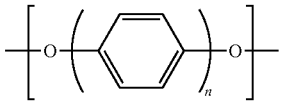
(3)
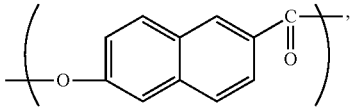
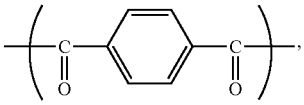
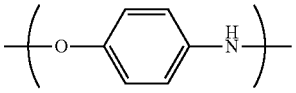
(4)
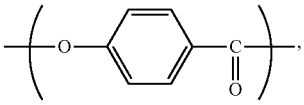
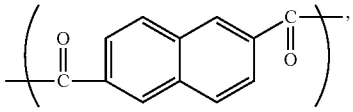
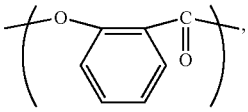
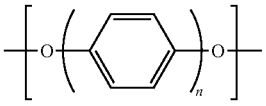
(5)
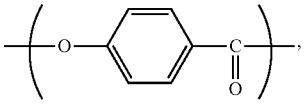
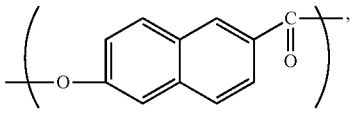
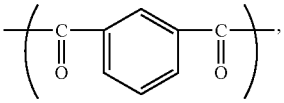
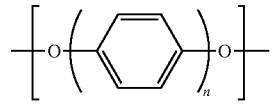
(6)
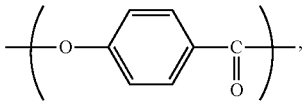
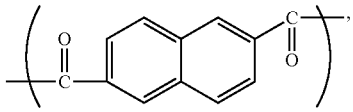
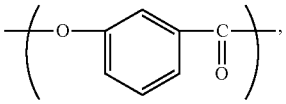
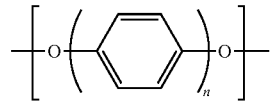
(7)
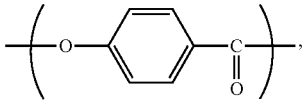
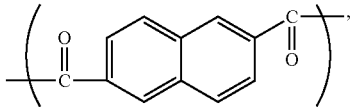
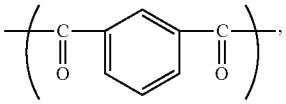
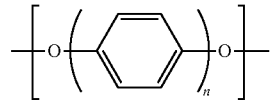
(8)
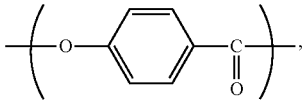
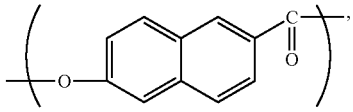
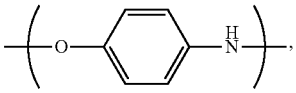
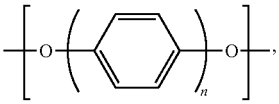

TABLE 2-continued
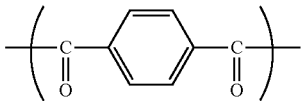
TABLE 3
(9)
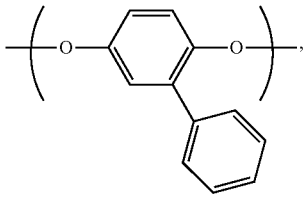
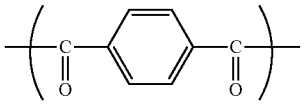
(10)
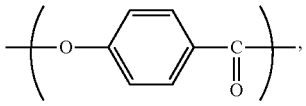
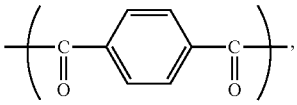
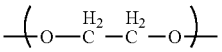
(11)
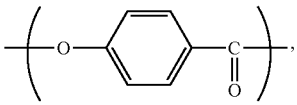
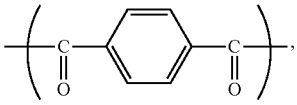
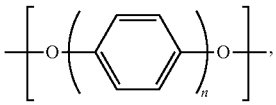
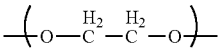
(12)
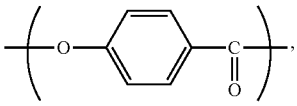
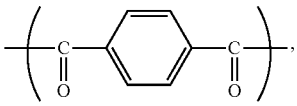
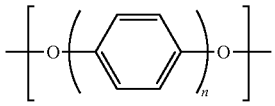
TABLE 3-continued
(13)
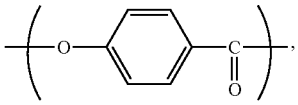
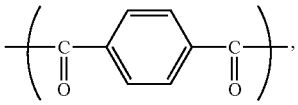
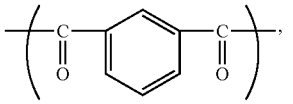
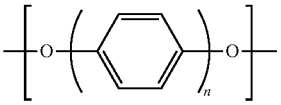
(14)
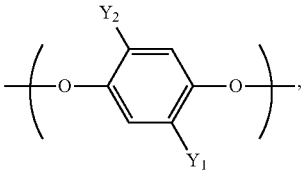
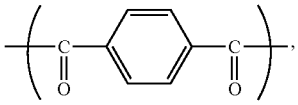
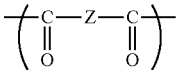
(15)
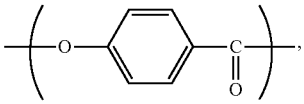
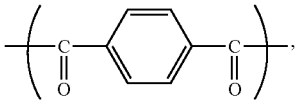
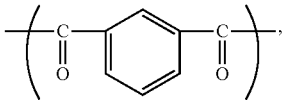
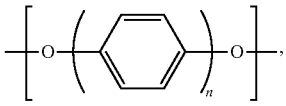
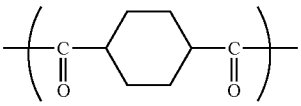

TABLE 4

(16)

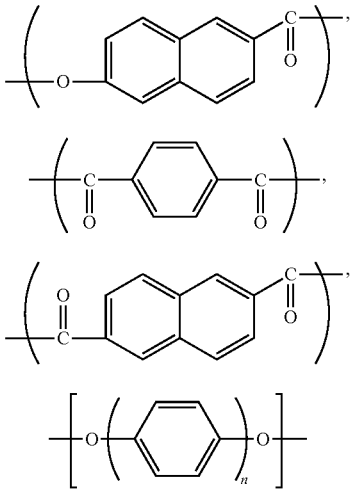

(17)

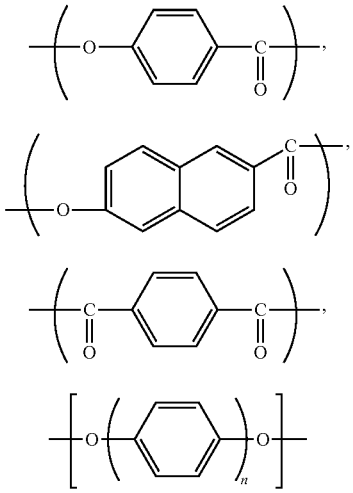

(18)

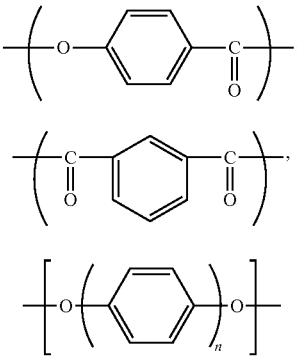

Z in species (14) of Table 3 may comprise divalent groups represented by the formulae below.

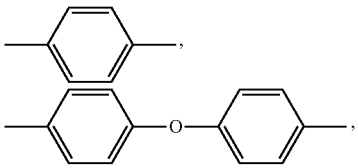

-continued

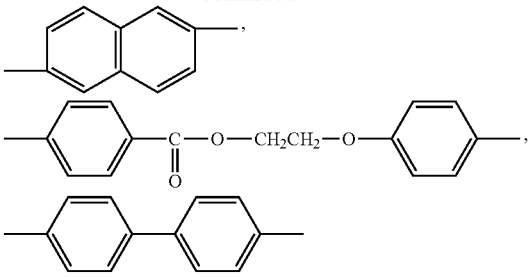

In some embodiments a liquid crystalline polyester may be a combination comprising a naphthalene skeleton as a polymerized unit. Particularly, it may include both a polymerized unit (A) derived from hydroxybenzoic acid and a polymerized unit (B) derived from hydroxynaphthoic acid. For example, the unit (A) may be of formula (A) and the unit (B) may be of formula (B). From the viewpoint of improving melt moldability, a ratio of the units (A) to the units (B) may be in a range of from 9/1 to 1/1, preferably 7/1 to 1/1, and more preferably 5/1 to 1/1.

(A)

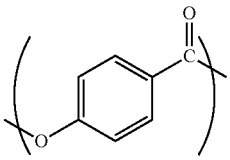

(B)

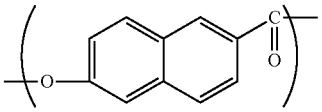

The total of the polymerized units (A) and the polymerized units (B) may be, for example, about 65 mol % or more, or about 70 mol % or more, or about 80 mol % or more, based on the total polymerized units. In some embodiments the braided sheath may include a liquid crystalline polyester comprising about 4 to about 45 mol % of the polymerized unit (B) in the polymer.

The melting point as used herein is a main absorption peak temperature which is measured and observed by a differential scanning calorimeter (DSC) (e.g., "TA3000" manufactured by METTLER Co.) in accordance with the JIS K7121 test method. Specifically, 10 to 20 mg of a sample is used in the above-mentioned DSC apparatus and, after the sample is encapsulated in an aluminum pan, nitrogen is allowed to flow as a carrier gas at a flow rate of 100 cc/minute and an endothermic peak upon heating at a rate of 20° C./minute is measured. When a well-defined peak does not appear at the first run in the DSC measurement depending on the type of the polymer, the temperature is raised to a temperature which is 50° C. higher than an expected flow temperature at a temperature rise rate (or heating rate) of 50° C./minute, followed by complete melting at the same temperature for 3 minutes and further cooling to 50° C. at a temperature drop rate (or cooling rate) of −80° C./minute. Thereafter, the endothermic peak may be measured at a temperature rise rate of 20° C./minute.

Commercially available LCPs contained in braided sheaths of the present disclosure may include VECTRAN® HT BLACK manufactured by KURARAY CO., LTD., VEC- TRAN® HT manufactured by KURARAY CO., LTD., SIVERAS® manufactured by Toray Industries, Inc., monofilament manufactured by ZEUS and ZXION® manufactured by KB SEIREN, LTD.

Liquid crystalline polyesters may be used alone or in combination in core-sheath structures of the present disclosure.

According to the present invention, "aramid fiber" means a polyamide fiber with high heat resistance and high strength comprising a molecular skeleton composed of an aromatic (benzene) ring. Aramid fibers may be classified into a para-aramid fiber and a meta-aramid fiber according to a chemical structure thereof, with para-aramid fibers being preferably included in some braided sheaths of the present disclosure.

Examples of commercially available aramid and co-polymer aramid fibers include para-aramid fibers, for example, KEVLAR® manufactured by E.I. du Pont de Nemours and Company, HERACRON® from Kolon Industries Inc. and TWARON® and TECHNORA® manufactured by Teijin Limited; and meta-aramid fibers, for example, NOMEX® manufactured by E.I. du Pont de Nemours and Company and CONEX® manufactured by Teijin Limited.

When contained in braided sheaths of the present disclosure, aramid fibers may be used alone or in combination. In some embodiments the plurality of filaments contained in shaped and/or non-shaped strands used to prepare the braided sheath may contain a co-polymer aramid filament. For example, in some embodiments the shaped and/or non-shaped strands comprise a copolyparaphenylene/3,4'-oxydiphenylene terephthalamide filament. This material is conventionally referred to as TECHNORA® and is available from Teijin.

Polyparaphenylenebenzobisoxazole (poly(p-phenylene-2,6-benzobisoxazole) (PBO) fibers are commercially available as ZYLON® AS and ZYLON® HM manufactured by TOYOBO CO., LTD.

Core-sheath structures of the present disclosure may also be formed of polyether ether ketone (PEEK) materials such as VICTREX™ PEEK polymers. In some embodiments the use of high-dpf PEEK polymers as components of the jacket (sheath) and/or the core can impart the core-sheath structures with improved tensile properties.

Ultra-high molecular weight polyethylene fibers used in core-sheath structures of the present disclosure may have an intrinsic viscosity in a range of from about 5.0, or from about 7.0, or from about 10, to about 30, or to about 28, or to about 24 dL/g. When the intrinsic viscosity of the "ultra-high molecular weight polyethylene fiber" is in a range of from about 5.0 to about 30 dL/g, fibers having good dimensional stability are obtained.

ASTM standards (for example Test Methods D789, D1243, D1601, and D4603, and Practice D3591) that describe dilute solution viscosity procedures for specific polymers, such as nylon, poly(vinyl chloride), polyethylene, and poly(ethylene terephthalate) are available. Generally, the polymer is dissolved in dilute solution and a drop time through a capillary tube versus a control sample is measured at a specific temperature.

A weight average molecular weight of the "ultra-high molecular weight polyethylene fiber" may be from about 700,000, or from about 800,000, or from about 900,000, to about 8,000,000, or to about 7,000,000, or to about 6,000,000. When the weight average molecular weight of the "ultra-high molecular weight polyethylene fiber" is in the range of from about 700,000 to about 8,000,000, high tensile strength and elastic modulus may be obtained.

Due to difficulties in determining the weight average molecular weight of "ultra-high molecular weight polyethylene fibers" using GPC methods, it is possible to determine the weight average molecular weight based on a value of the above mentioned intrinsic viscosity according to the equation below mentioned in "Polymer Handbook Fourth Edition, Chapter 4 (John Wiley, published 1999)".

$$\text{Weight average molecular weight} = 5.365\times10^{4}\times(\text{intrinsic viscosity})^{1.37}$$

In some embodiments it may be preferable for the repeating units of a "ultra-high molecular weight polyethylene fiber" to contain substantially ethylene. However, it may be possible to use, in addition to a homopolymer of ethylene, a copolymer of ethylene with a small amount of another monomer, for example, α-olefin, acrylic acid and derivatives thereof, methacrylic acid and derivatives thereof, and vinylsilane and derivatives thereof. The polyethylene fiber may have a partial crosslinked structure. The polyethylene fiber may also be a blend of a high-density polyethylene with an ultra-high molecular weight polyethylene, a blend of a low-density polyethylene with an ultra-high molecular weight polyethylene, or a blend of a high-density polyethylene, a low-density polyethylene with an ultra-high molecular weight polyethylene. The polyethylene fiber may be a combination of two or more ultra-high molecular weight polyethylenes having different weight average molecular weights, or two or more polyethylenes having different molecular weight distributions.

Commercially available "ultra-high molecular weight polyethylene fibers" include DYNEEMA® SK60, DYNEEMA® SK, IZANAS SK60 and IZANAS SK71 manufactured by TOYOBO CO., LTD.; and SPECTRA FIBER 900® and SPECTRA FIBER 1000 manufactured by Honeywell, Ltd.

These "ultra-high molecular weight polyethylene fibers" can be used alone or in combination.

The core composition may be of any high performance polymer filament(s) previously described and may be filaments selected from the group consisting of a liquid crystalline polyester filament, an aramid filament, co-polymer aramid filament, a polyether ether ketone filament, a poly (p-phenylene benzobisoxazole) filament, an ultra-high molecular weight polyethylene filament, a high modulus polyethylene filament, a polypropylene filament, a polyethylene terephthalate filament, a polyamide filament, a high-strength polyvinyl alcohol filament and combinations thereof.

The core component filament composition may be selected and structured for specific properties related to the intended end use of the core-sheath structure.

Along with the polymer composition of the core, the weave or braid and/or twist of the braided sheath (jacket) may also be adjusted to control the load sharing contribution of the core and the braided sheath. In this manner the overall tensile strength and dimensional stability of core-sheath structures of the present disclosure can be increased while maintaining or decreasing the overall diameter of the core-sheath structures.

In some embodiments core-sheath structures of the present disclosure may contain an LCP-based core and an LCP-based braided sheath.

In some embodiments the performance and characteristics of core-sheath structures of the present disclosure may be modified and managed by applying finish compositions to the core and/or the braided sheath. For example, at least one of the core and the braided sheath may contain a filament, fiber or strand having a coating of a cross-linked silicone polymer, or a non-cross-linked silicone polymer or a long chain fatty acid. Suitable long chain fatty acids may include stearic acid.

Application of cross-linking silicone polymers, especially to the filaments contained in the strands of the braided sheath and/or the core may provide advantageous performance enhancement to the tensile strength of core-sheath structures of the present invention.

Generally, there are three crosslinking reaction methods available to prepare silicone resins: 1) peroxide cure wherein heat activation of polymerization occurs under the formation of peroxide free radicals; 2) condensation in the presence of a tin salt or titanium alkoxide catalyst under the influence of heat or moisture; and 3) addition reaction chemistry catalyzed by a platinum or rhodium complex which may be temperature- or photo-initiated.

A cross-linked silicone coating may enhance moisture resistance of coated strands and may also enhance the lubricity of the strands such that, when the core-sheath structure is under longitudinal stress, the braid responds more efficiently in comparison to a non-coated structure where frictional interaction may need to be overcome.

Coating compositions of the present disclosure may be applied via surface application techniques which are known to those skilled in the art. These surface application techniques may include simple pumping finish solutions through a finish guide where the fiber comes into contact with the finish and is wicked into the fiber bundle via capillary action. Alternatively, other techniques may include spraying, rolling, or submersion application techniques such as dip coating. Subsequent treatment of the fiber with finish solution applied may include contact with roller or rollers for the purpose of setting the finish and/or influencing the degree of cross linking in a finish formulation. The roller(s) may or may not be heated. The coating composition may then be cured to cause cross-linking of the cross-linkable silicone polymer. When thermal curing is used the temperature may be from about 20° C., or from about 50° C., or from about 120° C., to about 200° C., or to about 170° C., or to about 150° C. The curing temperature may be determined by the thermal stability properties of the filament, fiber or strand and the actual cross-linking system being employed.

The degree of the cross-linking obtained may be controlled to provide differing degrees of flexibility or other surface characteristics to the filament, fiber or strand. The degree of crosslinking may be determined by the method described in U.S. Pat. No. 8,881,496 B2 where the coating is extracted with a solvent which dissolves monomer, but not the crosslinked polymer. The degree of cross-linking may be determined by the difference in weight before and after the extraction.

The degree of cross-linking may be at least about 20%, or at least about 30%, or at least about 50%, based on the total weight of the coating. The maximum degree of cross-linking may be about 100%. The weight of the cross-linked coating may be from about 1 wt % to about 20 wt %, or to about 10 wt %, or to about 5 wt %, based on the total weight of the filament, fiber or strand.

Cords and Tension Members

Another aspect relates to cords obtained by the methods disclosed herein for producing core-sheath structures. In some embodiments a maximum diameter of the cord may range from about 15 μm to about 20 mm. In other embodiments the maximum diameter of the cord may range from about 20 μm to about 5 mm, or from about 30 μm to about 4 mm, or from about 40 μm to about 3.5 mm, or from about 50 μm to about 3 mm, or from about 50 μm to about 2 mm.

Cords of the present disclosure may be designed to satisfy various properties including break tenacity. In some embodiments a break tenacity of the cord is at least 15 cN/dtex. In other embodiments the break tenacity of the cord may range from about 4 cN/dtex to about 40 cN/dtex, or from about 13 cN/dtex to about 31 cN/dtex, or from about 15 cN/dtex to about 26 cN/dtex.

Cords of the present disclosure include tension members that are useful in various applications including medical cords. For example, embodiments of the present disclosure include sutures having core-sheath structures produced by the methods describe herein, as well as catheter navigation cables and assemblies, steering cables and assemblies, device deployment control cables and assemblies, and torque and tension transmission cables and assemblies, just to name a few.

Tension members of the present disclosure may comprise a cord having a linear mass density ranging from about 30 denier to about 10,000 denier. In other embodiments the linear mass density of the tension member may range from about 40 denier to about 4500 denier, or from about 50 denier to about 4000 denier, or from about 100 denier to about 3000 denier, or from about 70 denier to about 2000 denier, or from about 80 denier to about 1500 denier, or from about 90 denier to about 1000 denier.

Embodiments

Embodiment [1] of the present disclosure relates to a method for producing a cord having a core-sheath structure, the method comprising shaping at least one filament bundle comprising a plurality of filaments to form at least one shaped strand of filaments; and braiding a plurality of strands, including the at least one shaped strand of filaments, over a core to form the core-sheath structure comprising a braided sheath of the strands surrounding the core, wherein: the shaped strand of filaments is an untwisted strand having a twist level of less than 1 turn per meter; a cross-sectional aspect ratio of the shaped strand of filaments is at least 3:1, as measured in the braided sheath; a thickness of at least a portion of the braided sheath ranges from about 10 to about 200 μm; and the braided sheath comprises a synthetic fiber having a tensile strength of greater than 12 cN/dtex.

Embodiment [2] of the present disclosure relates to the method of Embodiment [1] wherein the shaping occurs such that the shaped strand of filaments has a cross section including a curved surface, the shaping occurs such that the shaped strand of filaments has a cross section including a flat surface, or a combination thereof.

Embodiment [3] of the present disclosure relates to the method of at least one of Embodiments [1] and [2], wherein the shaped strand of filaments has an oval cross section, the shaped strand of filaments has a curved cross section including a convex section and a concave section, or the shaped strand of filaments is a flat fiber band having a cross section including a flat surface.

Embodiment [4] of the present disclosure relates to the method of at least one of Embodiments [1]-[3], wherein the plurality of filaments contained in the filament bundle include at least one filament having a non-round cross section.

Embodiment [5] of the present disclosure relates to the method of at least one of Embodiments [1]-[4], wherein the shaping comprises tensioning the at least one filament bundle over at least one surface.

Embodiment [6] of the present disclosure relates to the method of at least one of Embodiments [1]-[5], wherein the shaping comprises tensioning the at least one filament bundle over at least one roller.

Embodiment [7] of the present disclosure relates to the method of at least one of Embodiments [1]-[6], wherein the shaping comprises tensioning the at least one filament bundle over at least one curved surface such that the filaments separate from one another to form a flat fiber band.

Embodiment [8] of the present disclosure relates to the method of at least one of Embodiments [1]-[7], wherein the shaping comprises tensioning the at least one filament bundle over at least two rollers.

Embodiment [9] of the present disclosure relates to the method of at least one of Embodiments [1]-[8], wherein the shaping comprises squeezing the at least one filament bundle between two surfaces.

Embodiment [10] of the present disclosure relates to the method of at least one of Embodiments [1]-[9], wherein the shaping comprises squeezing the at least one filament bundle between two rollers.

Embodiment [11] of the present disclosure relates to the method of at least one of Embodiments [1]-[10], wherein a maximum diameter of the cord ranges from about 40 μm to less than about 5 mm.

Embodiment [12] of the present disclosure relates to the method of at least one of Embodiments [1]-[11], wherein a maximum diameter of the core ranges from about 20 μm to about 5 mm.

Embodiment [13] of the present disclosure relates to the method of at least one of Embodiments [1]-[12], wherein a ratio of a maximum diameter of the braided sheath to a minimum diameter of the braided sheath ranges from 1.05:1.0 to 2.5:1.0.

Embodiment [14] of the present disclosure relates to the method of at least one of Embodiments [1]-[13], wherein the plurality of strands consist of the at least one shaped strand of filaments.

Embodiment [15] of the present disclosure relates to the method of at least one of Embodiments [1]-[14], wherein the shaped strand of filaments has a flattening factor (F) ranging from 0.05 to 0.45, where the flattening factor (F) is defined as follows:

$$F = \frac{(D_{max} - D_{min})}{2D_s}$$

in which $D_{max}$ is a maximum diameter of the braided sheath, as measured in a cross-sectional plane of the cord that is perpendicular to a longitudinal axis of the cord, in micrometers (μm); $D_{min}$ is a minimum diameter of the braided sheath, as measured in the cross-sectional plane of the cord that is perpendicular to the longitudinal axis of the cord, in micrometers (μm); and $D_s$ is a minimum diameter of the filament bundle prior to the shaping, as measured in a cross-sectional plane of the filament bundle that is perpendicular to a longitudinal axis of the filament bundle, in micrometers (μm).

Embodiment [16] of the present disclosure relates to the method of at least one of Embodiments [1]-[13] and [15], wherein the plurality of strands includes at least one non-shaped strand having a cross-sectional aspect ratio of less than 2:1.

Embodiment [17] of the present disclosure relates to the method of at least one of Embodiments [1]-[16], wherein the plurality of strands includes at least one twisted strand having a twist level of from greater than 0 to 1600 turns per meter.

Embodiment [18] of the present disclosure relates to the method of at least one of Embodiments [1]-[17], wherein the core comprises at least two core strands twisted together at a twist level of from greater than 0 to 1600 turns per meter.

Embodiment [19] of the present disclosure relates to the method of at least one of Embodiments [1]-[18], wherein the core is a braided core.

Embodiment [20] of the present disclosure relates to the method of at least one of Embodiments [1]-[19], wherein: the core comprises at least two core strands twisted together at a twist level of from greater than 0 to 1600 turns per meter, the core is a braided core, or a combination thereof; or the plurality of strands includes at least one non-shaped strand having a cross-sectional aspect ratio of less than 2:1.

Embodiment [21] of the present disclosure relates to the method of at least one of Embodiments [1]-[20], wherein the braided sheath is a triaxial braid comprising: angled strands having a braid angle ranging from 5° to less than 90° in a relaxed state, said angled strands including the at least one shaped strand of filaments; and longitudinal strands having a braid angle of less than 5° in a relaxed state.

Embodiment [22] of the present disclosure relates to the method of at least one of Embodiment [1]-[21], further comprising shaping at least one of the longitudinal strands to form at least one shaped longitudinal strand prior to the braiding of the plurality of strands.

Embodiment [23] of the present disclosure relates to the method of at least one of Embodiments [1]-[22], wherein the filament bundle further comprises a lubricant, a fiber, a surface-coated filament, or combinations thereof.

Embodiment [24] of the present disclosure relates to the method of at least one of Embodiments [1]-[23], wherein the filament bundle includes at least one of a lubricating filament and a lubricating fiber.

Embodiment [25] of the present disclosure relates to the method of at least one of Embodiments [1]-[24], wherein the shaping occurs with at least one of a heated filament bundle and an agitated filament bundle.

Embodiment [26] of the present disclosure relates to the method of at least one of Embodiments [1]-[25], wherein a surface coverage of the braided sheath over the core is at least 85%.

Embodiment [27] of the present disclosure relates to the method of at least one of Embodiments [1]-[26], wherein a tensile strength of the shaped strand of filaments is greater than 12 cN/dtex.

Embodiment [28] of the present disclosure relates to the method of at least one of Embodiments [1]-[27], wherein the braided sheath does not include a synthetic fiber having a tensile strength of less than 12 cN/dtex.

Embodiment [29] of the present disclosure relates to the method of at least one of Embodiments [1]-[28], wherein a pick count of the braided sheath in a relaxed state is from 30 to 3000 filament unit crossovers per meter.

Embodiment [30] of the present disclosure relates to the method of at least one of Embodiments [1]-[29], wherein a strand (end) count of the braided sheath is from 4 to 24 ends.

Embodiment [31] of the present disclosure relates to the method of at least one of Embodiments [1]-[30], wherein a mass ratio of a mass of the braided sheath to a mass of the core per unit length of the cord is from about 5/95 to about 45/55.

Embodiment [32] of the present disclosure relates to the method of at least one of Embodiments [1]-[31], wherein a linear mass density of the cord is from about 30 to about 10,000 denier.

Embodiment [33] of the present disclosure relates to the method of at least one of Embodiments [1]-[32], where a linear mass density of the braided sheath is greater than a linear mass density of the core.

Embodiment [34] of the present disclosure relates to the method of at least one of Embodiments [1]-[33], wherein the plurality of filaments comprises filaments having linear mass densities ranging from about 0.1 to about 30 denier.

Embodiment [35] of the present disclosure relates to the method of at least one of Embodiments [1]-[34], wherein the core is a surface treated core.

Embodiment [36] of the present disclosure relates to the method of at least one of Embodiments [1]-[35], wherein a braid angle of the braided sheath in a relaxed state ranges from about 5° to about 85°.

Embodiment [37] of the present disclosure relates to the method of at least one of Embodiments [1]-[36], wherein the plurality of filaments comprises at least one selected from the group consisting of a liquid crystalline polyester filament, an aramid filament, co-polymer aramid filament, a polyether ether ketone filament, a poly(p-phenylene benzobisoxazole) filament, an ultra-high molecular weight polyethylene filament, a high modulus polyethylene filament, a polypropylene filament, a polyethylene terephthalate filament, a polyamide filament, a polyhydroquinone diimidazopyridine filament, and a high-strength polyvinyl alcohol filament.

Embodiment [38] of the present disclosure relates to the method of at least one of Embodiments [1]-[37], wherein the plurality of filaments comprises at least two selected from the group consisting of a liquid crystalline polyester filament, an aramid filament, co-polymer aramid filament, a polyether ether ketone filament, a poly(p-phenylene benzobisoxazole) filament, an ultra-high molecular weight polyethylene filament, a high modulus polyethylene filament, a polypropylene filament, a polyethylene terephthalate filament, a polyamide filament, a polyhydroquinone diimidazopyridine filament, and a high-strength polyvinyl alcohol filament.

Embodiment [39] of the present disclosure relates to the method of at least one of Embodiments [1]-[38], wherein the plurality of filaments comprises a co-polymer aramid filament.

Embodiment [40] of the present disclosure relates to the method of at least one of Embodiments [1]-[39], wherein the plurality of filaments comprises a copolyparaphenylene/3, 4'-oxydiphenylene terephthalamide filament.

Embodiment [41] of the present disclosure relates to the method of at least one of Embodiments [1]-[40], wherein the core comprises at least one selected from the group consisting of a liquid crystalline polyester filament, an aramid filament, co-polymer aramid filament, a polyether ether ketone filament, a poly(phenylene benzobisoxazole) filament, an ultra-high molecular weight polyethylene filament, a polypropylene filament, a high modulus polyethylene filament, a polyethylene terephthalate filament, a polyamide filament, and a high-strength polyvinyl alcohol filament.

Embodiment [42] of the present disclosure relates to the method of at least one of Embodiments [1]-[41], wherein an ovality of the shaped strand of filaments ranges from about 67% to about 98%.

Embodiment [43] of the present disclosure relates to the method of at least one of Embodiments [1]-[42], where a break tenacity of the cord is at least 15 cN/dtex.

Embodiment [44] of the present disclosure relates to a cord obtained by the method of at least one of Embodiments [1]-[43], wherein a maximum diameter of the cord ranges from about 40 μm to about 10 mm.

Embodiment [45] of the present disclosure relates to a tension member, comprising the cord of Embodiment [44], wherein a linear mass density of the cord is from about 30 to about 10,000 denier.

Embodiment [46] of the present disclosure relates to the tension member of Embodiment [45], wherein the tension member is a medical cord.

Embodiment [47] of the present disclosure relates to the tension member of at least one of Embodiments [45] and [46], wherein the tension member is a suture.

Embodiment [48] of the present disclosure relates to a cord having a core-sheath structure, comprising a core and a braided sheath of strands surrounding the core, the braided sheath comprising strands having a braid angle of 5° or more in a relaxed state, wherein the strands having the braid angle of 5° or more in the relaxed state include at least one shaped strand of filaments, the shaped strand of filaments is an untwisted strand having a twist level of less than 1 turn per meter, a cross-sectional aspect ratio of the shaped strand of filaments is at least 3:1, as measured in the braided sheath, a thickness of at least a portion of the braided sheath ranges from about 20 to about 200 μm, and the braided sheath comprises a synthetic fiber having a tensile strength of greater than 12 cN/dtex.

Embodiment [49] of the present disclosure relates to the cord of Embodiment [48], wherein the shaped strand of filaments has a cross section including a curved surface, the shaped strand of filaments has a cross section including a flat surface, or a combination thereof.

Embodiment [50] of the present disclosure relates to the cord of at least one of Embodiments [48] and [49], wherein the shaped strand of filaments has an oval cross section, the shaped strand of filaments has a curved cross section including a convex section and a concave section, or the shaped strand of filaments is a flat fiber band having a cross section including a flat surface.

Embodiment [51] of the present disclosure relates to the cord of at least one of Embodiments [48]-[50], wherein the shaped strand of filaments includes at least one filament having a non-round cross section.

Embodiment [52] of the present disclosure relates to the cord of at least one of Embodiments [48]-[51], wherein the shaped strand of filaments is formed by tensioning a filament bundle over at least one surface.

Embodiment [53] of the present disclosure relates to the cord of at least one of Embodiments [48]-[52], wherein the shaped strand of filaments is formed by tensioning a filament bundle over at least one roller.

Embodiment [54] of the present disclosure relates to the cord of at least one of Embodiments [48]-[53], wherein the shaped strand of filaments is formed by tensioning a filament bundle over at least one curved surface such that filaments separate from one another to form a flat fiber band.

Embodiment [55] of the present disclosure relates to the cord of at least one of Embodiments [48]-[54], wherein the shaped strand of filaments is formed by tensioning a filament bundle over at least two rollers.

Embodiment [56] of the present disclosure relates to the cord of at least one of Embodiments [48]-[55], wherein the shaped strand of filaments is formed by squeezing a filament bundle between two surfaces.

Embodiment [57] of the present disclosure relates to the cord of at least one of Embodiments [48]-[56], wherein the shaped strand of filaments is formed by squeezing a filament bundle between two rollers.

Embodiment [58] of the present disclosure relates to the cord of at least one of Embodiments [48]-[57], wherein a maximum diameter of the cord ranges from about 40 μm to less than about 5 mm.

Embodiment [59] of the present disclosure relates to the cord of at least one of Embodiments [48]-[58], wherein a maximum diameter of the core ranges from about 20 μm to about 5 mm.

Embodiment [60] of the present disclosure relates to the cord of at least one of Embodiments [48]-[59], wherein a ratio of a maximum diameter of the braided sheath to a minimum diameter of the braided sheath ranges from 1.05:1.0 to 2.5:1.0.

Embodiment [61] of the present disclosure relates to the cord of at least one of Embodiments [48]-[60], wherein the strands having the braid angle of 5° or more consist of the at least one shaped strand of filaments.

Embodiment [62] of the present disclosure relates to the cord of at least one of Embodiments [48]-[61], wherein the shaped strand of filaments has a flattening factor (F) ranging from 0.05 to 0.45, where the flattening factor (F) is defined as follows:

$$F = \frac{(D_{max} - D_{min})}{2D_s}$$

in which: $D_{max}$ is a maximum diameter of the braided sheath, as measured in a cross-sectional plane of the cord that is perpendicular to a longitudinal axis of the cord, in micrometers (μm); $D_{min}$ is a minimum diameter of the braided sheath, as measured in the cross-sectional plane of the cord that is perpendicular to the longitudinal axis of the cord, in micrometers (μm); and $D_s$ is a minimum diameter of the filament bundle prior to the shaping, as measured in a cross-sectional plane of the filament bundle that is perpendicular to a longitudinal axis of the filament bundle, in micrometers (μm).

Embodiment [63] of the present disclosure relates to the cord of at least one of Embodiments [48]-[62], wherein the braided sheath includes at least one non-shaped strand having a cross-sectional aspect ratio of less than 2:1.

Embodiment [64] of the present disclosure relates to the cord of at least one of Embodiments [48]-[63], wherein the braided sheath includes at least one twisted strand having a twist level of from greater than 0 to 1600 turns per meter.

Embodiment [65] of the present disclosure relates to the cord of at least one of Embodiments [48]-[64], wherein the core comprises at least two core strands twisted together at a twist level of from greater than 0 to 1600 turns per meter.

Embodiment [66] of the present disclosure relates to the cord of at least one of Embodiments [48]-[65], wherein the core is a braided core.

Embodiment [67] of the present disclosure relates to the cord of at least one of Embodiments [48]-[66], wherein: the core comprises at least two core strands twisted together at a twist level of from greater than 0 to 1600 turns per meter, the core is a braided core, or a combination thereof; or the braided sheath includes at least one non-shaped strand having a cross-sectional aspect ratio of less than 2:1.

Embodiment [68] of the present disclosure relates to the cord of at least one of Embodiments [48]-[67], wherein the braided sheath further comprises longitudinal strands having a braid angle of less than 5° in the relaxed state.

Embodiment [69] of the present disclosure relates to the cord of at least one of Embodiments [48]-[68], wherein the braided sheath further comprises longitudinal strands having a braid angle of less than 5° in the relaxed state, and the longitudinal strands comprise at least one shaped longitudinal strand having a cross-sectional aspect ratio of at least 3:1.

Embodiment [70] of the present disclosure relates to the cord of at least one of Embodiments [48]-[69], wherein the shaped strand of filaments further comprises a lubricant, a fiber, a surface-coated filament, or combinations thereof.

Embodiment [71] of the present disclosure relates to the cord of at least one of Embodiments [48]-[70], wherein the shaped strand of filaments includes at least one of a lubricating filament and a lubricating fiber.

Embodiment [72] of the present disclosure relates to the cord of at least one of Embodiments [48]-[71], wherein a surface coverage of the braided sheath over the core is at least 85%.

Embodiment [73] of the present disclosure relates to the cord of at least one of Embodiments [48]-[72], wherein a tensile strength of the shaped strand of filaments is at least about 12 cN/dtex or more.

Embodiment [74] of the present disclosure relates to the cord of at least one of Embodiments [48]-[73], wherein the braided sheath does not include a synthetic fiber having a tensile strength of less than 12 cN/dtex.

Embodiment [75] of the present disclosure relates to the cord of at least one of Embodiments [48]-[74], wherein a pick count of the braided sheath in a relaxed state is from 30 to 3000 filament unit crossovers per meter.

Embodiment [76] of the present disclosure relates to the cord of at least one of Embodiments [48]-[75], wherein a strand (end) count of the braided sheath is from 4 to 24 ends.

Embodiment [77] of the present disclosure relates to the cord of at least one of Embodiments [48]-[76], wherein a mass ratio of a mass of the braided sheath to a mass of the core per unit length of the cord is from about 5/95 to about 45/55.

Embodiment [78] of the present disclosure relates to the cord of at least one of Embodiments [48]-[77], wherein a linear mass density of the cord is from about 30 to about 10,000 denier.

Embodiment [79] of the present disclosure relates to the cord of at least one of Embodiments [48]-[78], where a linear mass density of the braided sheath is greater than a linear mass density of the core.

Embodiment [80] of the present disclosure relates to the cord of at least one of Embodiments [48]-[79], wherein the shaped strand of filaments comprises filaments having linear mass densities ranging from about 0.1 to about 30 denier.

Embodiment [81] of the present disclosure relates to the cord of at least one of Embodiments [48]-[80], wherein the core is a surface treated core.

Embodiment [82] of the present disclosure relates to the cord of at least one of Embodiments [48]-[81], wherein a braid angle of the braided sheath in a relaxed state ranges from about 5° to about 85°.

Embodiment [83] of the present disclosure relates to the cord of at least one of Embodiments [48]-[82], wherein the shaped strand of filaments comprises at least one selected from the group consisting of a liquid crystalline polyester filament, an aramid filament, co-polymer aramid filament, a polyether ether ketone filament, a poly(p-phenylene benzobisoxazole) filament, an ultra-high molecular weight polyethylene filament, a high modulus polyethylene filament, a polypropylene filament, a polyethylene terephthalate filament, a polyamide filament, a polyhydroquinone diimidazopyridine filament, and a high-strength polyvinyl alcohol filament.

Embodiment [84] of the present disclosure relates to the cord of at least one of Embodiments [48]-[83], wherein the shaped strand of filaments comprises at least two selected from the group consisting of a liquid crystalline polyester filament, an aramid filament, co-polymer aramid filament, a polyether ether ketone filament, a poly(p-phenylene benzobisoxazole) filament, an ultra-high molecular weight polyethylene filament, a high modulus polyethylene filament, a polypropylene filament, a polyethylene terephthalate filament, a polyamide filament, a polyhydroquinone diimidazopyridine filament, and a high-strength polyvinyl alcohol filament.

Embodiment [85] of the present disclosure relates to the cord of at least one of Embodiments [48]-[84], wherein the shaped strand of filaments comprises a co-polymer aramid filament.

Embodiment [86] of the present disclosure relates to the cord of at least one of Embodiments [48]-[85], wherein the plurality of filaments comprises a copolyparaphenylene/3, 4'-oxydiphenylene terephthalamide filament.

Embodiment [87] of the present disclosure relates to the cord of at least one of Embodiments [48]-[86], wherein the core comprises at least one selected from the group consisting of a liquid crystalline polyester filament, an aramid filament, co-polymer aramid filament, a polyether ether ketone filament, a poly(phenylene benzobisoxazole) filament, an ultra-high molecular weight polyethylene filament, a polypropylene filament, a high modulus polyethylene filament, a polyethylene terephthalate filament, a polyamide filament, and a high-strength polyvinyl alcohol filament.

Embodiment [88] of the present disclosure relates to the cord of at least one of Embodiments [48]-[87], wherein an ovality of the shaped strand of filaments ranges from about 67% to about 98%.

Embodiment [89] of the present disclosure relates to the cord of at least one of Embodiments [48]-[88], where a break tenacity of the cord is at least 15 cN/dtex.

Embodiment [90] of the present disclosure relates to the cord of at least one of Embodiments [48]-[89], wherein a maximum diameter of the cord ranges from about 40 μm to about 10 mm.

Embodiment [91] of the present disclosure relates to a tension member, comprising the cord of at least one of Embodiments [48]-[90], wherein a linear mass density of the cord is from about 30 to about 10,000 denier.

Embodiment [92] of the present disclosure relates to the tension member of Embodiment [91], wherein the tension member is a medical cord.

Embodiment [93] of the present disclosure relates to the tension member of at least one of Embodiments [91] and [92], wherein the tension member is a suture.

The above description is presented to enable a person skilled in the art to make and use the invention, and is provided in the context of a particular application and its requirements. Various modifications to the embodiments disclosed herein will be readily apparent to those skilled in the art, and the generic principles defined herein may be applied to other embodiments and applications without departing from the spirit and scope of the invention. Thus, this invention is not intended to be limited to the embodiments shown, but is to be accorded the widest scope consistent with the principles and features disclosed herein. In this regard, certain embodiments within the disclosure may not show every benefit of the invention, considered broadly.

What is claimed is:

1. A cord having a core-sheath structure, comprising:

a core, and a braided sheath of strands surrounding the core, the braided sheath comprising strands having a braid angle of 5° or more in a relaxed state, wherein:

the strands having the braid angle of 5° or more in the relaxed state consist of shaped strands of filaments;

each shaped strand of filaments is an untwisted strand having a twist level of less than 1 turn per meter;

a cross-sectional aspect ratio of each shaped strand of filaments is at least 3:1, as measured in the braided sheath;

a thickness of at least a portion of the braided sheath ranges from about 20 to about 200 um; and the braided sheath comprises a synthetic fiber having a tensile strength of greater than 12 cN/dtex.

2. The cord of claim 1, wherein:

each shaped strand of filaments has a cross section including a curved surface;

each shaped strand of filaments has a cross section including a flat surface; or a combination thereof.

3. The cord of claim 1, wherein:

each shaped strand of filaments has an oval cross section;

each shaped strand of filaments has a curved cross section including a convex section and a concave section; or each shaped strand of filaments is a flat fiber band having a cross section including a flat surface.

4. The cord of claim 1, wherein each shaped strand of filaments includes at least one filament having a non-round cross section.

5. The cord of claim 1, wherein each shaped strand of filaments is formed by tensioning a filament bundle over at least one surface.

6. The cord of claim 1, wherein each shaped strand of filaments is formed by tensioning a filament bundle over at least one curved surface such that the filaments separate from one another to form a flat fiber band.

7. The cord of claim 1, wherein each shaped strand of filaments is formed by squeezing a filament bundle between two surfaces.

8. The cord of claim 1, wherein a maximum diameter of the cord ranges from about 40 μm to less than about 5 mm.

9. The cord of claim 1, wherein a ratio of a maximum diameter of the braided sheath to a minimum diameter of the braided sheath ranges from 1.05:1.0 to 2.5:1.0.

10. The cord of claim 1, wherein each shaped strand of filaments has a flattening factor (F) ranging from 0.05 to 0.45, where the flattening factor (F) is defined as follows:

$$F = \frac{(D_{max} - D_{min})}{2D_s}$$

in which:

$D_{max}$ is a maximum diameter of the braided sheath, as measured in a cross-sectional plane of the cord that is perpendicular to a longitudinal axis of the cord, in micrometers (μm);

$D_{min}$ is a minimum diameter of the braided sheath, as measured in the cross-sectional plane of the cord that is perpendicular to the longitudinal axis of the cord, in micrometers (μm); and $D_s$ is a minimum diameter of the filament bundle prior to the shaping, as measured in a cross-sectional plane of the filament bundle that is perpendicular to a longitudinal axis of the filament bundle, in micrometers (μm).

11. The cord of claim 1, wherein the core is a braided core.

12. The cord of claim 1, wherein at least one of the shaped strands of filaments further comprises a lubricant, a fiber, a surface-coated filament, or combinations thereof.

13. The cord of claim 1, wherein a tensile strength of at least one of the shaped strands of filaments is greater than 12 cN/dtex.

14. The cord of claim 1, wherein at least one of the shaped strands of filaments comprises at least one selected from the group consisting of a liquid crystalline polyester filament, an aramid filament, co-polymer aramid filament, a polyether ether ketone filament, a poly(p-phenylene benzobisoxazole) filament, an ultra-high molecular weight polyethylene filament, a high modulus polyethylene filament, a polypropylene filament, a polyethylene terephthalate filament, a polyamide filament, a polyhydroquinone diimidazopyridine filament, and a high-strength polyvinyl alcohol filament.

15. The cord of claim 1, wherein at least one of the shaped strands of filaments comprises a co-polymer aramid filament.

16. The cord of claim 1, wherein the core comprises at least one selected from the group consisting of a liquid crystalline polyester filament, an aramid filament, co-polymer aramid filament, a polyether ether ketone filament, a poly(phenylene benzobisoxazole) filament, an ultra-high molecular weight polyethylene filament, a polypropylene filament, a high modulus polyethylene filament, a polyethylene terephthalate filament, a polyamide filament, and a high-strength polyvinyl alcohol filament.

* * * * *